US007125656B2

(12) United States Patent
Ito

(10) Patent No.: US 7,125,656 B2
(45) Date of Patent: Oct. 24, 2006

(54) METHOD FOR PREPARATION OF ORGANIC SILVER SALT AND PHOTOTHERMOGRAPHIC IMAGING MATERIAL

(75) Inventor: Satoshi Ito, Hino (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 64 days.

(21) Appl. No.: 10/995,123

(22) Filed: Nov. 24, 2004

(65) Prior Publication Data

US 2005/0118544 A1 Jun. 2, 2005

(30) Foreign Application Priority Data

Nov. 28, 2003 (JP) ..... 2003-398806

(51) Int. Cl.

| | |
|---|---|
| ***G03C 5/18*** | (2006.01) |
| ***G03C 5/26*** | (2006.01) |
| ***G03C 5/16*** | (2006.01) |
| ***G03C 1/00*** | (2006.01) |

(52) U.S. Cl. ..... 430/449; 430/617; 430/618; 430/619; 430/620; 430/348

(58) Field of Classification Search ..... 430/617–620, 430/348, 449

See application file for complete search history.

(56) References Cited

U.S. PATENT DOCUMENTS

2002/0048734 A1* 4/2002 Fukui et al. ..... 430/620

* cited by examiner

*Primary Examiner*—Geraldine Letscher
(74) *Attorney, Agent, or Firm*—Finnegan, Henderson, Farabow, Garrett & Dunner, L.L.P.

(57) ABSTRACT

Organic silver salt particles are manufacture by mixing an aqueous solution containing silver ions with an aqueous solution containing an organic acid alkali salt to form organic silver salt particles, using a mixing device in which plural supply tubes are connected to a discharge tube so that an axis of the discharge tube and axes of the supply tubes coincide at a single point.

19 Claims, 7 Drawing Sheets

METHOD FOR PREPARATION OF ORGANIC SILVER SALT AND PHOTOTHERMOGRAPHIC IMAGING MATERIAL

FIELD OF THE INVENTION

The present invention relates to a method for the preparation of organic silver salt particles for use in photothermographic imaging materials.

BACKGROUND OF THE INVENTION

There has been known a thermally developable photothermographic imaging material which comprises a photocatalyst such as silver halide, a reducing agent and an organic silver salt reducible by the reducing agent and in which a latent image formed by exposure forms a black silver image by thermal development via oxidation-reduction (or redox) reaction between the organic silver salt and the reducing agent.

Organic silver salt particles, in general, are formed in a mixing vessel provided with a dynamic stirring means which conducts a stirring operation such as rotation. Formation methods of organic silver salt particles and preparation apparatuses thereof include, for example, a method using a closed mixing means, as disclosed in JP-A No. 2001-33907 (hereinafter, the term JP-A refers to an unexamined Japanese Patent Application Publication). JP-A No. 2003-43607 also discloses a preparation method of organic silver salt particles using a micro-mixer.

However, formation of particles in a mixing vessel incorporating a stirring means causes problems that produced nucleus particles are cycled and returned, whereby nucleation cannot be performed under a homogeneous condition.

In the method disclosed in JP-A No. 2001-33907, the closed mixing means is internally installed with a stirring means, making a complex structure and problems such as retention of fluid cannot be ignored microscopically. In a closed-type continuous mixing system, retention of fluid not only becomes a factor of perturbing particle sizes of an organic silver salt or the distribution thereof but it also results in increased fogging caused by retained particles being exposed to silver ions at relatively high concentration.

In the use of the micro-mixer disclosed in JP-A No. 2003-43607, static mixing is conducted without using an internal mixing means and mixing is performed in a laminar flow state. In this method, the reaction zone is so small that mixing needs to be conducted not only at relatively low solution-supplying rate but also using a solution at relatively low concentration, resulting in reduced productivity.

SUMMARY OF THE INVENTION

Accordingly, it is an object of this invention to solve the foregoing problems in preparation techniques of organic silver salt used for photothermographic materials and to provide a technique for preparing a photothermographic imaging material exhibiting reduced fogging at relatively high productivity and photothermographic imaging materials manufactured by such a technique.

In one aspect the present invention is directed to a method of preparing organic silver salt particles comprising (a) supplying an aqueous solution containing silver ions and an aqueous solution containing an organic acid alkali salt, (b) mixing the aqueous solution containing silver ions with the aqueous solution containing an organic acid alkali salt to form organic silver salt particles, and (c) discharging a solution containing the organic silver salt particles, wherein the aqueous solution containing silver ions and the aqueous solution containing an organic acid alkali salt are each supplied through supply tubes and the solution containing the organic silver salt particles is discharged through a discharge tube, wherein a center axis of the discharge tube coincides at a single point with center axes of the supply tubes.

In another aspect the present invention is directed to a method of preparing organic silver salt particles comprising mixing an aqueous silver ion solution and an aqueous solution or suspension of an organic acid alkali salt to form organic silver salt particles, wherein the aqueous silver ion solution and the aqueous solution or suspension of an organic acid alkali salt are mixed using a mixing device comprising plural supply tubes for supplying the aqueous silver ion solution and the aqueous solution or suspension of an organic acid alkali salt and a discharge tube for discharging the organic silver salt particles, in which the discharge tube is connected with the plural supply tubes so that an axis of the discharge tube coincides at a single point with axes of the plural supply tubes, while supplying the aqueous silver ion solution and the aqueous solution or suspension of an organic acid alkali salt from the supply tubes to form organic silver salt particles.

DETAILED DESCRIPTION OF THE INVENTION

Figure 1:
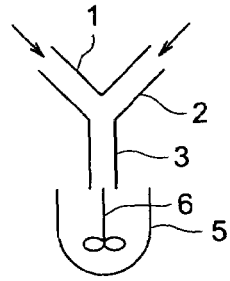
FIGS. 1(*a*) to 1(*d*) are illustrations of a mixing device usable in this invention.
Figure 1:
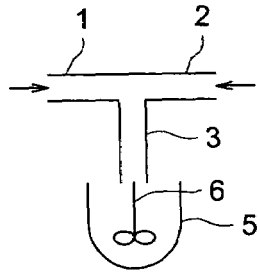
Figure 1:
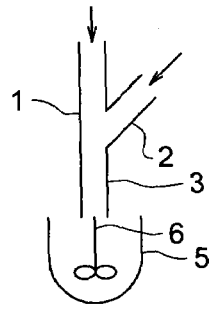
Figure 1:
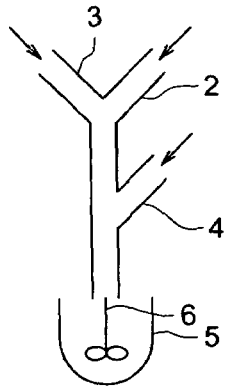

A thermally developable photothermographic imaging material (hereinafter, also denoted simply as photothermographic material) relating to this invention comprises on a support a light-sensitive layer comprising a light-sensitive emulsion containing organic silver salt particles and light-sensitive silver halide grains, a reducing agent for silver ions, and a binder.

First, there will be described a light-sensitive emulsion containing organic silver salt particles and light-sensitive silver halide grains.

In the light-sensitive emulsion, light-sensitive silver halide grains having an average grain size of 0.001 to 0.050 μm preferably account for at least 50%, more preferably 50% to 100%, still more preferably 75% to 100%, and optimally 90% to 100% by weight, based on the total silver content of light-sensitive silver halide grains.

The light-sensitive silver halide grains preferably have an average grain size of 0.001 to 0.050 μm, and more preferably 0.01 to 0.05 μm. The grain size as described above is defined as an average edge length of silver halide grains, in cases where they are so-called regular crystals in the form of a cube or octahedron. Further, in cases where grains are not-regular crystal crystals such as spherical grains or needle grains, the grain size refers to the diameter of a sphere having the same volume, so-called a sphere equivalent diameter. Furthermore, in cases where grains are tabular grains, the grain size refers to the diameter of a circle having the same area as the projected area of the major faces.

The light-sensitive silver halide grains are contained preferably at a silver coverage of 0.01 to 1.0, and more preferably 0.01 to 0.2 g per $m^2$ of the photothermographic material.

Silver halide grains falling into the foregoing range of grain size and silver coverage achieves superior photographic performance, such as an enhanced density at the same silver coverage and also results in reduced haze (turbidity), leading to enhanced image quality. A grain size of less than 0.001 μm results in markedly reduced sensitivity and also causes coagulation in the process of preparation of organic silver salts, whereby the grain size distribution markedly broadens and sufficient reduction in haze (turbidity) cannot be achieved. A grain size of more than 0.05 μm results in problems of haze. Further, when the silver coverage is less than 0.01 g/$m^2$, it results in a deficient objective function as photothermographic material, whereby sufficient photographic performance cannot be achieved. When the silver coverage is more than 1 g/$m^2$, problems arise with haze (turbidity).

Halide composition of light-sensitive silver halide used in this invention is not specifically limited, including silver chloride, silver chlorobromide, silver bromide, silver iodobromide and silver iodochlorobromide. The distribution of halide composition within the grain may be homogeneous or the halide composition may vary step-wise or continuously within the grain. Silver halide grains having a core/shell structure are preferred. The structure is preferably comprised of two- to five-fold halide composition and core/shell grains having a two- to four-fold structure are more preferred. There is also preferably employed a technique of allowing silver bromide to localize on the silver chloride or chlorobromide grain surface.

Formation of light-sensitive silver halide grains can be achieved by methods known in the art, such as those described in Research Disclosure No. 17029 (June, 1978), and U.S. Pat. No. 3,70,458. Specifically, a silver-supplying compound and a halide supplying compound are mixed in a solution of gelatin or other polymers to form light-sensitive silver halide, followed by being mixed with an organic silver salt.

The silver halide grains may be cubic or octahedral grains, tabular grains, spherical grains, needle grains or potato-like grains, and cubic grains or tabular grains are preferred. Tabular silver halide grains preferably have an average aspect ratio of from 100:1 to 2:1, and more preferably from 50:1 to 3:1. Rounded silver halide grains are also preferred. The external face index (Miller index) of light-sensitive silver halide grains is not specifically limited. When spectrally sensitized, a [100] face exhibiting high spectral sensitization efficiency is preferably at a high ratio. The [100] face preferably accounts for at least 50%, more preferably at least 65% and still more preferably at least 80%. The ratio accounted for by the Miller index [100] face can be obtained based on T. Tani, J. Imaging Sci., 29, 165 (1985) in which adsorption dependency of a [111] face or a [100] face is utilized.

Silver halide grains may include iridium compounds. Water-soluble iridium compounds usable in this invention include, for example, iridium (III) halide compounds, iridium (IV) compounds, and iridium complexes having a ligand such as a halogen, amines and an oxalate, such as hexachloroiridium (III) or (IV) complex, hexaamineiridium (III) or (IV) complex, trioxalatoiridium (III) or (IV), hexacyanoiridium and pentachloronitosyliridium. These compounds can be use in any combination. The iridium compounds can be used through solution in water or appropriate solvents. An aqueous solution of hydrogen halides (for example, hydrochloric acid, hydrobromic acid, hydrofluoric acid) or alkali halides (e.g., KCl. KBr, NaBr) may be added to enhance stability of an iridium compound solution. Instead of using soluble iridium compounds, iridium-doped silver halide grains may be added and dissolved in the stage of preparation of silver halide grains.

A water-soluble iridium compound can be added at the time of preparing silver halide grains or at any time before coating a coating solution containing a silver halide emulsion, and preferably at the time of forming silver halide grains to be occluded within the silver halide grains. The water soluble iridium compound is preferably added at $1\times10^{-8}$ to $1\times10^{-3}$ mol, more preferably $1\times10^{-8}$ to $5\times10^{-5}$ mol, and still more preferably $5\times10^{-8}$ to $5\times10^{-6}$ mol per mol of silver halide.

Light-sensitive silver halide grains may contain a metal or a metal complex of group VII or VIII (7 to 10 groups) of the periodical table, other than iridium. Preferred examples of such a central metal include rhodium, rhenium, ruthenium and osmium. These metal complexes may be used alone or in combinations. The content thereof preferably is $1\times10^{-9}$ to $1\times10^{-3}$ mol and more preferably $1\times10^{-8}$ to $1\times10^{-4}$ mol per mol of silver halide. Specifically, metal complexes having a structure described in JP-A No. 7-225449 can be used.

Water-soluble rhodium compounds are usable and examples thereof include for example, rhodium (III) halide compounds or rhodium complexes having a ligand such as a halogen, amines, oxalate, e.g., hexachlororhodium (III) complex, pentachloroaquorhodium (III) complex, tetrachlorodiaquorhodium (III) complex, hexabromorhodium (III) complex, hexaamminerhodium (III) complex, and trioxatorhodium complex. These rhodium compounds are used through solution in water or a suitable solvent, and as is often applied, is an aqueous hydrogen halide solution (e.g., hydrochloric acid, hydrobromic acid, hydrofluoric acid) or alkali halides (e.g., KCl, NaCl, KBr, NaBr) were added thereto to stabilize the rhodium compound solution. Instead of using soluble rhodium compounds, rhodium-doped silver halide grains may be added and dissolved during the stage of preparation of silver halide rains. The rhodium compound is incorporated preferably at $1\times10^{-8}$ to $5\times10^{-6}$ mol, more preferably $5\times10^{-8}$ to $1\times10^{-6}$ mol. These compounds can be added at the time of preparing silver halide grains or at any time before coating a coating solution containing a silver halide emulsion, and preferably at the time of forming silver halide grains to be occluded within the silver halide grains.

Rhenium, ruthenium and osmium are added in the form of a water-soluble complex salt, as described in JP-A Nos. 1-285941, 2-20852 and 2-20855, and a six-coordinate complex represented by the following formula is preferred:

$$[ML_6]^{n-}$$

wherein M is Ru, Re or Os; L is a ligand; and n is 0, 1, 2, 3 or 4. In that case, counter-ions are not so essential, and ammonium or alkali metal ions are usable. Preferred ligands include, for example, a halide ligand, a cyanide ligand, a cyanate ligand, a nitrosyl ligand and a thionitrosyl ligand. Specific examples thereof are shown below but are by no means limited to these examples:

$[ReCl_6]^{3-}$, $[ReBr_6]^{3-}$, $[ReCl^5(NO)]^{2-}$, $[Re(NS)Br_5]^{2-}$, $[Re(NO)CN_5]^{2-}$, $[Re(O)_2CN_4]^{3-}$, $[RuCl_6]^{3-}$, $[RuCl_4(H_2O)_2]^{-}$, $[RuCl_5(H_2O)]^{2-}$, $[RuCl_5(NO)]^{2-}$, $[Ru(CO)_3Cl_3]^{2-}$, $[Ru(CO)Cl_5]^{2-}$, $[Ru(CO)Br_5]^{2-}$, $[OsCl_6]^{3-}$, $[OsCl_5(NO)]^{2-}$, $[Os(NO)(CN)_6]^{3-}$, $[Os(NS)Br_5]^{2-}$, and $[Os(O)_2(CN)_4]^{4-}$.

The foregoing compounds are incorporated preferably at $1\times10^{-9}$ to $1\times10^{-5}$ mol, more preferably $1\times10^{-8}$ to $1\times10^{-6}$ mol. These compounds can be added at the time of preparing silver halide grains or at any time before coating a coating solution containing a silver halide emulsion, and preferably at the time of forming silver halide grains to be occluded within the silver halide grains.

The compounds are added during formation of silver halide grains to be occluded within the silver halide grains in such a manner that a powdery metal complex or an aqueous solution obtained by dissolving it with NaCl or KCl is added to an aqueous solution of a water-soluble salt or a water-soluble halide during the formation of silver halide grains; when silver salt and halide solutions are simultaneously added, the foregoing aqueous solution is concurrently added to perform simultaneous addition of three solutions; or an aqueous metal complex solution is added into a reaction vessel in a necessary amount during the formation of silver halide grains. It is specifically preferred to add a powdery metal complex or an aqueous solution obtained by dissolving it with NaCl or KCl.

To achieve occlusion in the vicinity of the grain surface, an aqueous metal complex solution is added into a reaction vessel at an appropriate amount immediately after completion of silver halide grain formation, during or after physical ripening, or during chemical ripening.

Further, silver halide grains may contain metal atoms such as cobalt, iron, nickel, chromium, palladium platinum, gold, thallium, copper or lead. Cobalt, iron, nickel and ruthenium compounds are used preferably in the form of a hexacyanometal complex. Specific examples thereof include ferricyanate ion, ferrocyanate ion, hexacyanocobalt acid ion, hexacyanochromium acid ion, and hexacyanoruthenium acid ion but are not limited to the foregoing. The metal complex may be contained homogeneously within the grain, at relatively high content in the core portion or at relative high content in the shell portion, but it is not specifically limited. The metal complexes can be incorporated preferably incorporated at $1\times10^{-9}$ to $1\times10^{-4}$ mol per mol of silver halide. The metal complexes can be added in the form of a simple salt, a double salt or complex salt during grain formation.

The thus prepared silver halide grain emulsion can be desalted by any commonly known washing method, such as the noodle washing method or flocculation method, or may not be desalted.

Silver halide emulsion is preferably subjected to chemical sensitization. Examples of chemical sensitization include sulfur sensitization, gold sensitization, selenium sensitization, tellurium sensitization, and noble metal sensitization.

Preferably used sulfur sensitization is usually conducted in such a manner that after adding a sulfur sensitizer, the silver halide emulsion is stirred at a temperature of 40° C. or more over a given period of time. Commonly known compounds are usable as a sulfur sensitizer, including a sulfur compound contained in gelatin and various kinds of sulfur compounds, such as a thiosulfate, thioureas, thiazoles, and rhodanines, of which preferred sulfur compounds are thiosulfate and thiourea compounds. The addition amount of a sulfur sensitizer, depending on pH, temperature or silver halide grain size during chemical ripening, is preferably from $1\times10^{-7}$ to $1\times10^{-2}$, and more preferably from $1\times10^{-5}$ to $1\times10^{-3}$ per mol of silver halide.

Commonly known selenium compounds are usable as a selenium sensitizer. Selenium sensitization is usually conducted in such a manner that adding an unstable-type or nonunstable-type selenium compounds, a silver halide emulsion is stirred at a temperature of 40° C. or higher over a given period of time. Unstable-type selenium compounds include, for example, those described in JP-B Nos. 44-15748 and 43-13489 (hereinafter, the term, JP-B refers to Japanese Patent Publication), and JP-A Nos. 4-25832, 4-109240, and 4-324855. Specifically, compounds represented by general formulas (VIII) and (IX) in JP-A 4-324855 are preferred.

A tellurium sensitizer is a compound capable of forming silver telluride as a sensitizing speck on the surface, or in the interior of silver halide grains. The formation rate of silver telluride in a silver halide emulsion can be tested in the manner described, for example, in JP-A No. 5-313284. Examples of tellurium sensitizer include diacyltellurides, bis(oxycarbonyl)tellurides, bis(carbamoyl)tellurides, bis (oxycarbonyl)ditellurides, bis(carbamoyl)ditellurides, compounds containing a P═Te bond, tellurocarboxylates, Te-organyltellurocarboxylic acid esters, di(poly)tellurides, tellurides, tellurols, telluroacetals, tellurosulfonates, compounds containing a P—Te bond, Te-containing heterocyclic compounds, tellurocarbonyl compounds, inorganic tellurium compounds and colloidal tellurium. Specifically, there can be used compounds described in U.S. Pat. Nos. 1,623,499, 3,320,069, 3,772,031; British Patent Nos. 235,211, 1,121,496, 1,295,462, 1396,696; Canadian Patent No. 800,958; JP-A No. 4-204640; JP-N No. 2654722, 299029 and 2811257; J. Chem. Soc. Chem. Commun., 635 (1980), ibid-1102 (1979), ibid 645 (1979); J. Chem. Soc. Perkin. Trans. 1, 2191 (1980); S. Patai ed., The Chemistry of Organic Selenium and Tellurium Compounds, Vol. 1 (1986), and Vol. 2 (1987). Of these, compounds represented by general formulas (II), (III) and (IV) described in JP-A No. 5-313284 are preferred.

The amount of a selenium or tellurium sensitizer used for sensitization, depending on silver halide grains and chemical ripening conditions, is preferably from $1\times10^{-8}$ to $1\times10^{-2}$, and more preferably $1\times10^{-7}$ to $1\times10^{-3}$ mol per mol of silver halide. The chemical sensitization conditions are not specifically limited and the pH and pAg are preferably 5 to 8 and 6 to 11 (more preferably 7 to 10), respectively, while the temperature is preferably from 40 to 95° C., and more preferably from 45 to 85° C.

Gold sensitizers used for gold sensitization of silver halide emulsion include gold compounds having a gold oxidation number of +1 or +3 and those usable as a gold sensitizer can be used. Representative examples thereof include chloroauric acid, potassium chloroaurate, auric trichloride, potassium auric thiocyanate, potassium iodoaurate, tetracyanoauric acid, ammonium aurothiocyanate and pyridyltrichlorogold. The amount of a gold sensitizer, depending on various conditions, is preferably from $1\times10^{-7}$ to $1\times10^{-3}$, more preferably $1\times10^{-6}$ to $5\times10^{-4}$ mol per mol of silver halide.

Silver halide emulsions can employ a combination of a gold sensitizer with other chemical sensitizers. Preferred combinations thereof include sulfur sensitization and gold sensitization; selenium sensitization and gold sensitization; sulfur sensitization, selenium sensitization and gold sensitization; sulfur sensitization, tellurium sensitization and gold sensitization; and sulfur sensitization, selenium sensitization and tellurium sensitization.

In the course of silver halide grain formation or physical ripening, cadmium salt, sulfite salt, lead salt or thallium salt may concurrently be present in the silver halide emulsion.

Reduction sensitization can also be employed. Specific examples of a compound used for reduction sensitization include ascorbic acid, thiourea dioxide, stannous chloride, aminoiminomethanesulfinic acid, hydrazine derivatives, borane compounds, silane compounds and polyamine compounds. Reduction sensitization can also performed by ripening a silver halide emulsion with maintaining the pH and pAg at 7 or more and 8.3 or less, respectively. Reduction sensitization can be done by introducing a single addition portion of a silver ion during grain formation.

Thiosulfonic acid compounds described in European Patent No. 293,917 may be effectively added to a light-sensitive silver halide emulsion.

Light-sensitive silver halide grains can be spectrally sensitized by adsorption of spectrally sensitizing dyes. There can be used sensitizing dyes such as a cyanine dye, a merocyanine dye, a complex cyanine dye, a complex merocyanine dye, a holopolar cyanine dye, a styryl dye, a hemicyanine dye, an oxonol dye, and hemi-oxonol dye. For example, there can be used sensitizing dyes described in JP-A Nos. 63-159841, 60-140335, 63-231427, 63-259651, 63-304242, 63-15245; U.S. Pat. Nos. 4,639,414, 4,740,455, 4,741,966, 4,751,175 and 4,835,096. Sensitizing dyes usable in this invention are described, for example, in RD17643, sect. IV-A (December, 1978, page 23), and ibid 18431 sect. X (August, 1978, page 437). There are preferably used sensitizing dyes having spectral sensitivity suitable for spectral characteristics of various light sources of a laser imagers and a scanner. For example, compounds described in JP-A Nos. 9-34078, 9-54409 and 9-80679 are preferred.

Silver halide emulsion used in the photothermographic material may be used alone or in combinations of two or more emulsions (differing, for example, in average grain size, halide composition, crystal habit, chemical sensitization condition).

Plural silver halide emulsions can be used to control gradation characteristic (gamma or γ). Plural silver halide emulsions differing in sensitivity can be obtained by controlling grain size, grain shape halide composition, adsorption amount of sensitizing dye and amount of chemical sensitizer. It is preferred that two to four (preferably two or three) kinds of silver halide emulsions are blended or coated in separate layers. The difference in sensitivity of silver halide emulsions preferably is at least 0.2LogE, and more preferably at least 0.3LogE. The term, LogE is a measure of sensitivity. Thus, after exposure through an optical wedge, in a characteristic curve comprising an ordinate of density and abscissa of exposure, it is a logarithmic value of exposure (E).

Techniques relating to these are described in JP-A Nos. 57-119341, 53-106125, 47-3929, 48-55730, 46-5187, 50-73627, and 57-150841. The upper limit of the sensitivity difference is not specifically limited and is at most 1.0LogE.

Organic silver salt particles used in the photothermographic material preferably have a number-average particle size of from 0.01 to 0.60 μm. The organic silver salt used in this invention is a silver salt which is relatively stable to light and forms a silver image when heated at a temperature of 80° C. or higher in the presence of exposed photocatalyst (for example, latent image of light-sensitive silver halide) and a reducing agent. The organic silver salt may be any organic material containing a source of reducible silver ions. Such light-insensitive organic silver salts are described, for example, in JP-A Nos. 6-130543, 8-314078, 9-127643, 10-62899 at col. No. [0048] to [0049], 10-94074, and 10-94075; European Patent No. 0,803,764A1 on page 18, line 24 to page 19, line 37, European Patent Nos. 0,962,812A1 and 1,004,930A2; JP-A Nos. 11-349591, 2000-7683, 2000-72711, 2000-112057 and 2000-155383. Of organic silver salts is preferred a silver salt of a long chain aliphatic carboxylic acid having 10 to 30 carbon atoms (preferably 15 to 28 carbon atoms). Preferred examples of an organic silver salt include silver behenate, silver arachidate, silver stearate, and their mixture, in which the content of silver behenate is preferably 50 to 100 mol %, and more preferably 80 to 100 mol %.

With respect to the shape of an organic silver salt, squama-form particles having a length-width ratio of from 1 to 9 are preferred. A length-width ratio of 1 to 9 causes no crushing of particles during dispersion, resulting in superior image lasting quality. The squama-form particle and the length-width ratio are defined as follows. When an organic silver salt is electron-microscopically observed and the form of the organic silver salt is approximated as a rectangular parallelepiped, edges of the rectangular parallelepiped are designated as "a", "b" and "c" in the order from the shortest one (provided that b and c may be equal), values x and y are calculated as follows:

$$x=b/a, \text{ and } y=c/b.$$

The x and y values are determined for approximately 200 particles and when the average value is designated as x(average) and the requirement, 30≧x(average)≧1.5 (preferably, 20≧x(average)≧2.0), it is defined to be a squama form. Further, a needle-form is to be 1.5≧x(average)≧1. The average value y(average) is defined to be the length-width ratio. The length-width ratio of organic silver salt particles preferably is from 1 to 9, more preferably from 1 to 6, and still more preferably from 1 to 3.

In the squama-form particles, "a" is regarded as the thickness of a tabular particle having a major face comprised of edges "b" and "c". The average "a" preferably is from 0.01 to 23 μm, and more preferably from 0.1 to 0.20 μm. In the squama-form particles, the ratio of a sphere equivalent diameter to "a" is defined as an aspect ratio. The aspect ratio of the squama-form particle is preferably from 1.1 to 30, and an aspect ratio falling within this range makes it difficult to cause aggregation in the photothermographic material, resulting in superior image lasting quality. The aspect ratio is more preferably from 1.1 to 15. The number-average particle size of organic silver salt preferably is from 0.01 to 0.60 μm (more preferably from 0.20 to 0.50 μm), expressed in sphere equivalent diameter, thereby making it difficult to cause aggregation in the photothermographic material, resulting in superior image lasting quality.

The particle size distribution of organic silver salt is preferably monodisperse. The expression, being monodisperse means that the percentage (coefficient of variation) of a value of a standard deviation of a volume-averaged diameter of organic silver salt particles, divided by the volume-weighted mean diameter is less than 100%, preferably not more than 80%, and more preferably not more than 50%. Measurement of particle size is preferably conducted in the manner that a laser light is irradiated onto organic silver salt particles dispersed in a dispersing medium and a self-correlation function is determined with respect to time variation of fluctuation of scattered light.

Organic silver salt particles are prepared preferably at a reaction temperature of 60° C. or less in terms of forming particles exhibiting a reduced minimum density. Although chemicals, such as aqueous organic acid alkali salt of a temperature of more than 60° C. may be added, the reaction vessel is preferably maintained at 60° C. or less, more preferably 50° C. or less, and still more preferably 40° C. or less.

The ph of a solution containing silver ions (for example, aqueous silver nitrate solution) preferably is from 1 to 6, and more preferably from 1.5 to 5.0. Acid or alkali may be added to adjust the pH of a solution containing silver ions, however, the kind of such an acid or alkali is not specifically limited.

After completion of addition of a silver ion-containing solution (for example, an aqueous silver nitrate solution) and/or an organic acid alkali metal solution or suspension, formed organic silver salts may be ripened even by ripened with raising the reaction temperature. A silver ion-containing solution and/or an organic acid alkali metal solution or suspension are by no means added during ripening. Ripening is conducted at a temperature from +1 to +20° C., and more preferably from +1 to +10° C. Ripening time is optimally determined.

In the preparation of organic silver salts, 0.5 to 30 mol % (preferably 3 to 20 mol %) of the whole organic acid alkali solution or suspension may be added alone after completion of addition of the silver ion-containing solution. This addition is conducted preferably as one of several divided additions. In cases when employing a closed mixing means, the addition may be performed to the closed mixing means or a reaction vessel but preferably to a reaction vessel. Performing such addition results in enhanced hydrophilicity, leading to superior film-forming properties and to an improvement in peeling-resistance of photothermographic material.

The silver ion concentration of a silver ion-containing solution (for example, an aqueous silver nitrate solution) is arbitrarily set and is preferably from 0.03 to 6.5 mol/l, and more preferably from 0.1 to 5 mol/l.

In this invention, at least one of a silver ion-containing solution, an organic acid alkali metal solution or suspension, and a solution to be prepared in advance in the reaction, preferably contains organic solvents in such an amount that the organic alkali salt becomes a transparent solution without forming string-form aggregates or micelles. This solution preferably employs water or an organic solvent alone, or a mixture of water and an organic solvent. There can-be use any organic solvent exhibiting the foregoing properties which do not adversely affect photographic performance, and a water-miscible alcohol or acetone is preferred.

Of alkali metals of the foregoing organic acid alkali salts, specifically, potassium salt is preferred. The organic acid alkali salt can be prepared by adding potassium hydroxide to an organic acid, in which it is preferred that the alkali amount is less than the equivalent amount of an organic acid to leave unreacted organic acid. The organic acid residue preferably is from 3 to 50 mol %, and more preferably from 3 to 30 mol %. After adding alkali in an intended amount or more, nitric acid or sulfuric acid is added thereto to neutralize any excessive alkali. Further, for example, a compound represented by general formula (1) described in JP-A No. 62-65035, an N-containing heterocyclic compound containing a water-solubilizing group described in JP-A No. 62-150240, an inorganic peroxide compound described in JP-A No. 50-101019, a sulfur compound described in JP-A No. 51-78319 and a disulfide compound described in JP-A No. 57-643 may be added to the solution contained in a closed mixing means to which the foregoing silver ion-containing solution, organic acid alkali salt solution or suspension, or both of them are to be added.

Aliphatic carboxylic acids (also known as fatty acids) are preferably used as an organic acid constituting an organic acid alkali salt and specific examples thereof include behenic acid, arachidic acid, stearic acid, and palmitic acid.

The organic acid alkali salt solution or suspension contains organic solvent preferably at 3% to 70%, and more preferably 5% to 50% by volume, based on water. Since the organic solvent volume is variable with temperature, the optimum organic solvent amount can be optimized. The content of an organic acid alkali salt is preferably from 5% to 50% by weight, more preferably from 7% to 45%, and still more preferably 10% to 40%.

The organic acid alkali salt solution or suspension is preferably maintained at a temperature at 50 to 90° C., more preferably 60 to 85° C., and still more preferably 65 to 85° C. to avoid crystallization or solidification of the organic acid alkali salt. It is preferred to maintain the temperature within the above range to control the reaction. Then, the organic acid alkali salt solution or suspension, heated to a high temperature, is rapidly cooled in the closed mixing means, and the rate of formation of microcrystalline precipitates and the rate of formation of an organic silver salt through the reaction with a solution containing silver ions is suitably controlled, preferably controlling the crystal form, the crystal size and the crystal size distribution of the organic silver salt. Concurrently, performance of the photothermographic material can also be enhanced.

A solvent may be incorporated into a reaction vessel in advance. The preferred solvent is water or a solvent mixture used in the organic acid alkali salt solution or suspension.

A dispersing aid soluble in an aqueous medium may be added to an organic acid alkali salt solution or suspension, a solution containing silver ions or a reaction solution. Specific examples thereof include dispersing aids used for organic silver salts described later.

In the preparation of organic silver salts, it is preferred to conduct desalting and dehydration after completion of silver salt formation. Methods therefor are not specifically limited and commonly known or conventional means are applicable, for example, including commonly known filtration such as centrifugal filtration, suction filtration and floc formation washing by flocculation, and decantation by centrifugal sedimentation. Of these, centrifugal separation is preferred. Desalting or dehydration may be conducted once or repeated plural times. Addition or removal of water may be conducted continuously or separately. Desalting and dehydration are conducted until removed water preferably reaches a conductivity of 300 μS/cm or less, more preferably 100 μS/cm or less, and still more preferably 60 μS/cm or less, in which the lower limit of conductivity is not specified but usually about 5 μS/cm.

Prior to desalting through ultrafiltration, it is preferred to disperse the solution until the particle size reaches two times the volume-weighted mean particle size of the final particles. Any appropriate dispersing means is applicable, such as a high-pressure homogenizer and a micro-fluidizer, as described later.

The temperature of liquid after particle formation and before desalting is preferably maintained at a low value. This is because organic solvent used for dissolution of an organic acid alkali salt permeates into the formed organic silver salt particles, easily forming silver nucleus particles during the liquid-supplying operation or desalting operation. It is therefore preferred to carry out desalting, while maintaining an organic silver salt dispersion at a temperature of from 1 to 30° C., and more preferably from 5 to 25° C.

A compound containing at least two reducible silver (I) ions within the molecule is also usable as light-insensitive organic silver salt. Specific examples thereof are described in Japanese Patent Application No. 2001-251399. There is also usable a silver salt of a polymer containing acrylic acid.

The organic silver salt is used preferably in an amount of 0.1 to 5 g/m$^2$, more preferably 0.3 to 3 g/m$^2$, and still more preferably 0.5 to 2 g/m$^2$, in terms of equivalent converted to silver.

Reducing agents contained in photothermographic material are those capable of reducing an organic silver salt to form a silver image. Preferred reducing agents are those described, for example, in U.S. Pat. Nos. 3,770,448, 3,773,512, 3,593,863, and RD 17029 and 29963. Specific examples include:

K1: 1,1-bis(2-hydroxy-3,5-dimethylphenyl)-3,5,5-trimethylhexane

K2: bis(2-hydroxy-3-t-butyl-5-methylphenyl)methane

K3: 2,2-bis(4-hydroxy-3-methylphenyl)propane

K4: 4,4-ethylidene-bis(2-t-butyl-6-methylphenyl)

K5: 2,2-bis(3,5-dimethyl-4-hydroxyphenyl)propane

Reducing agents are dispersed in water or dissolved in an organic solvent and allowed to be contained in a coating solution of a light-sensitive layer or a coating solution of an adjacent layer, and are then included in these layers. An organic solvent can optionally be selected from alcohols such as methanol or ethanol, ketones such as acetone or methyl ethyl ketone, and aromatics such as toluene or xylene. The reducing agent is preferably used in an amount of from $1\times10^{-2}$ to 10 mol, and more preferably from $1\times10^{-2}$ to 1.5 mol per mol of silver.

Binders suitable for photothermographic material are transparent or translucent, colorless one, for example, including natural polymers, synthetic resins (polymer, copolymer) and other film-forming medium described, for example, in JP-A No. 2001-330918 at paragraph [0069]. Of these, binders suitable for the light-sensitive layer of a photothermographic material are polyvinyl acetals, and a specifically preferred binder is polyvinyl butyral. Further, polymer exhibiting relatively high softening point, such as cellulose esters, specifically a polymer such as triacetyl cellulose or cellulose acetate butyrate, is preferable for an over-coat layer or an under-coat layer, specifically for a light-insensitive layer such as a protective layer. The foregoing polymers may be used in combination. Binders which have introduced through copolymerization or addition reaction, at least one polar group selected from —COOM, —$SO_3M$, —$OSO_3M$, —P═O$(OM)_2$ (in which M is a hydrogen atom or alkali metal), —$N(R)_2$, —$N^+(R)_3$ (in which R is a hydrocarbon group), an epoxy group, —SH, and —CN. Of these polar groups, —$SO_3M$ or —$OSO_3M$ is preferred. The content of such a polar group is preferably from $1\times10^{-1}$ to $1\times10^{-8}$, and more preferably from $1\times10^{-2}$ to $1\times10^{-6}$ mol/g.

The foregoing binders are to be used within the range effective as a binder. The effective range can be readily determined by one skilled in the art. For example, as a guideline in the case of holding at least an organic silver salt in the light-sensitive layer, the ratio of binder to organic silver salt is preferably from 15:1 to 1:2, and more preferably from 8:1 to 1:1. Namely, the binder content of the light-sensitive layer preferably is 1.5 to 6 g/m$^2$, and more preferably from 1.7 to 5 g/m$^2$. A content of less than 1.5 g/m$^2$ results in a markedly increased density in the unexposed area at a level unacceptable in practice.

The light-sensitive layer may contain an organic gelling agent.

In one preferred embodiment, coating composition of the light-sensitive layer contains a polymer latex. It is preferred that at least 50% by weight of the total binder amount of coating composition of the light-sensitive layer is accounted for by an aqueous-dispersed polymer latex.

Hydrophilic polymers such as gelatin, polyvinyl alcohol, methyl cellulose, hydroxypropyl cellulose, carboxymethyl cellulose, and hydroxypropylmethyl cellulose may be incorporated in an amount of not more than 50% by weight (preferably, not more than 30% by weight) of all the binders.

As is known in the art, the use of a cross-linking agent in a binder results in improved adhesion and reduced unevenness during development, while it is also effective to prevent fogging during storage and to inhibit formation of printed-out silver after development. Various cross-linking agents for use in conventional photographic materials are usable, including aldehyde type, epoxy type, ethyleneimine type, vinylsulfone-type, sulfonic acid ester type, acryloyl type, carbodiimide type and silane compound type cross-linking agents. Specifically, an isocyanate type compound, silane compound, epoxy compound and acid anhydride are preferred.

Hydrazine derivatives, vinyl compounds, quaternary onium compounds and silane compounds are usable as a silver saving agent. Specific examples of hydrazine derivatives include compounds H-1 to H-29, described in U.S. Pat. No. 5,545,505; compounds 1 to 12, described in U.S. Pat. No. 5,464,738; and compounds H-1-1 to H-1-28; H-2-1 to H-2-9, H-3-1 to H-3-12, H-4-1 to H-4-21 and H-5-1 to H-5-5, described in JP-A No. 2001-27790. Specific examples of vinyl compounds include compounds CN-01 to CN-13, described in U.S. Pat. No. 5,545,515; compounds HET-01 to HET-02 described in U.S. Pat. No. 5,635,339 in col. 10; compounds MA-01 to MA-07 described in U.S. Pat. No. 5,654,130; compounds IS-01 to IS-04, described in U.S. Pat. No. 5,705,324, at col. 9-10; and compounds 1-1 to 218-2, described in JP-A No. 2001-125224 in paragraph [0043] to [0088]. Specific examples of a quaternary onium compound include triphenyltetrazolium. Specific examples of silane compounds include alkoxysilane compound containing at least two primary or secondary amino groups, such as compounds A1 to A33, described in JP-A No. 2003-5324 in paragraph [0027] to [0029]. The foregoing silver saving agents are preferably used in an amount of $1\times10^{-5}$ to 1 mol, and more preferably $1\times10^{-4}$ to $5\times10^{-1}$ mol per mol of organic silver salt.

There may be used an antifoggant or an image stabilizer in the photothermographic material. The photothermographic material may optionally contain a silver image toning agent in the form of a dispersion in a gelatin matrix.

Examples of material used for a support or substrate of the photothermographic material include various kinds of polymeric materials, glass, wool fabrics, cotton fabrics, paper, and metals (e.g., aluminum). Of these, plastic film is preferred, such as cellulose acetate film, polyester film, polyethylene terephthalate film, polyethylene naphthalate film, polyamide film, polyimide film, cellulose triacetate film and polycarbonate film, and biaxially stretched polyethylene terephthalate film is specifically preferred. The thickness of a support is usually from 50 to 300 μm, and preferably from 70 to 180 μm.

Electrically conductive compounds such as metal oxide compounds and/or conductive polymer may be incorporated into a constituent layer to improve electrification property. These compounds may be incorporated into any layer, and preferably into a backing layer, a surface protective layer on the light-sensitive layer side or a subbing layer. There are also preferably used conductive compounds described in U.S. Pat. No. 5,244,773, col. 14–20.

The photothermographic material is to have at least one light-sensitive layer on the support. Such a light-sensitive layer may be provided alone on the support but it is preferred to provide at least one light-insensitive layer on the light-sensitive layer. For example, it is preferred to provide a protective layer to protect the light-sensitive layer and a back coat layer is provided on the opposite side of the support to prevent adhesion between photothermographic materials or onto a roll. A binder used for the protective layer or back coat layer preferably is a polymer, such as cellulose acetate or cellulose acetate butyrate, which exhibits a glass transition point higher than that of the light-sensitive layer and resistant to abrasion or deformation.

To adjust contrast, at least two light-sensitive layers may be provided on one side of the support and at least one light-sensitive layer may be provided on both sides of the support.

To control the quantity or the wavelength distribution of light transmitted through the light-sensitive layer, a filter layer may be provided on the side of the support identical or opposite to the light-sensitive layer. Alternatively, a dye or a pigment may be included in the light-sensitive layer. Commonly known compounds exhibiting absorption in various wavelengths corresponding to spectral sensitivity of a photothermographic material are employed as a dye.

The photothermographic material can be prepared in such a manner that coating solutions which have been prepared by dissolving or dispersing material used for the individual layers in solvent, are subjected to simultaneous multilayer coating, followed by a thermal treatment. Methods for simultaneous multilayer coating are not specifically limited and include, for example, a bar coater method, a curtain coat method, a dipping method, an air-knife method, a hopper method, a reverse roll coating method, a slide coating method, a gravure coating method and an extrusion coating method. Of these, a slide coating method and an extrusion coating method are preferred.

The coating weight of silver can be optimally chosen according to the objective of photothermographic material. For use in medical diagnostic imaging, for example, the coating weight of silver is preferably from 0.3 to 1.5 g/m$^2$, and more preferably from 0.5 to 1.5 g/m$^2$. Of the coating weight of silver, that of silver halide accounts for preferably 2% to 18%, and more preferably 5% to 15% of the total coating weight of silver. The coating density of organic silver salt is preferably from $1\times10^{-17}$ to $1\times10^{-14}$ g, and more preferably from $1\times10^{-16}$ to $1\times10^{-15}$ g per silver halide grain with a size of 0.01 μm or more (sphere equivalent diameter).

The photothermographic material preferably contains solvent in an amount of 5 to 1,000 mg/m$^2$, and more preferably 100 to 500 mg/m$^2$, thereby leading to enhanced sensitivity, reduced fogging and enhanced maximum density. Solvent usable in this invention include, for example, those described in JP-A No. 2001-264930, paragraph [0030] but are not limited to these. The solvent content of a photothermographic material can be adjusted by controlling drying conditions such as temperature in the drying stage after the coating stage. The solvent content can be determined by gas chromatography under the condition suitable for detection of the contained solvent.

Next, the preparation process of photothermographic material will be explained, however, embodiments of this invention are by no means limited to this.

In the method of preparing organic silver salt particles comprising (a) supplying an aqueous solution containing silver ions and an aqueous solution containing an organic acid alkali salt, (b) mixing the aqueous solution containing silver ions with the aqueous solution containing an organic acid alkali salt to form organic silver salt particles, and (c) discharging the organic silver salt particles, the above mixing (b) is achieved using a mixing device in which a discharge tube for discharging the organic silver salt particles is connected to plural supply tubes for supplying the aqueous solution containing silver ions and the aqueous solution containing an organic acid alkali salt so that a center axis of the discharge tube coincides at a single point with center axes of the plural supply tubes.

In a stirring apparatus using a conventional mixing vessel, produced nucleus particles are cycled and returned, rendering it difficult to form uniform nucleus particles in the nucleation stage, whereas, in this invention, produced nucleus particles are promptly discharged through a discharge tube, thereby rendering it possible to perform nucleation in a steady-state.

FIGS. 1(*a*) to 1(*d*) show illustrations of mixing devices usable in this invention. FIG. 1(*a*) illustrates a Y-mixer, FIG. 1(*b*) illustrates a T-mixer and FIG. 1(*c*) illustrates a deformed Y-mixer. In the FIGS. 1(*a*) to 1(*d*), a solution or suspension of organic acid alkali salt is supplied through a supply tube (1), a solution containing silver ions is supplied through a supply tube (2) and both solutions collide and are mixed to react with each other to form organic silver salt particles at the portion where the supply tubes (1) and (2) encounter with each other. FIG. 1(*d*) shows an example of the combination of the mixer of FIG. 1(*a*) with the mixer of FIG. 1(*c*), in which another supply tube (4) is connected to a discharge tube (3).

Both solutions are continuously supplied to perform continuous formation of organic silver salt particles. The thus formed particles are discharged through the discharge tube (3). The inside diameters of the supply tubes (1), (2) and (4) and the discharge tube (3) are each preferably from 1 mm to 100 mm. Center axes of supply tubes (1) and (2), and a center axis of the discharge tube (3) cross approximately at a single point. As a result, as described later, turbulent flow is formed, thereby allowing a solution or suspension of an organic acid alkali salt and a solution containing silver ions to be rapidly mixed within a short period of time. An inside diameter of les than 1 mm reduces a liquid supplying rate, resulting in not only insufficient mixing but also lowered productivity. An inside diameter of more than 100 mm makes it difficult to perform uniform mixing, resulting in poor mixing.

The discharge tube for discharging the organic silver salt particles is connected to plural supply tubes for supplying the aqueous solution containing silver ions and the aqueous solution containing an organic acid alkali salt so that a center axis of the discharge tube coincides at a single point with center axes of the plural supply tubes, that is, the center axis of the discharge tube and the center axes of the supply tubes cross at a single point. The center axis of a tube refers to a center line passing through the center of the section of the tube.

The expression, center axes of supply tubes and a center axis of the discharge tube crossing at a single point is not limited only to the desired case that axes of all tubes merge (or cross) at a single point but also includes the case that the gap between the axes falls within 10% of the inside diameter of the thickest tube of the connected tubes, whereby advantageous effects of this invention can be achieved.

The nucleus particles released from the discharge tube (3) are transferred to a vessel (5) and the particle dispersion is stirred by a stirring blade (6) and optionally, further subjected to ripening and growth. Growth is conducted by introducing a solution or suspension of an organic acid silver salt and a solution containing silver ions into the vessel (5) by double jet addition.

In the initial stage of preparing an organic silver salt emulsion, a silver nitrate solution and a solution or suspension of an organic acid alkali salt are mixed to form nucleus particles, in which a slight difference in flow rate between the silver nitrate solution and the solution of an organic acid alkali salt markedly varies a supersaturation degree, causing variation of the number of produced nucleus particles. Such variation affects the size, size distribution and aspect ratio of final particles. Accordingly, removal of non-steady nucleus particles produced in the initial stage of reaction renders stable nucleation feasible, whereby an organic silver salt emulsion with reduced variation in particle size-distribution can be stably prepared without causing any batch fluctuation. In the process of nucleation using the mixing device according to this invention, it is preferred that the reaction mixture is continuously monitored with respect to silver electrode potential (also denoted simply as silver potential) and nucleus particles produced after the variation of the silver potential has fallen within 2.0 mV (preferably 1 mV, and more preferably 0.5 mV), are used.

The silver amount of organic silver salt particles at the time of forming nucleus particles by mixing a silver nitrate solution and a solution or suspension of an organic acid alkali salt, greatly affects monodispersibility of the particles. Accordingly, the silver amount of organic silver salt particles at the time of forming nucleus particles by mixing a silver nitrate solution and a solution or suspension of an organic acid alkali salt is preferably not more than 0.01 mol/l and more preferably from 0.0001 to 0.01 mol/l, thereby resulting in monodisperse organic acid alkali salt particles. The upper limit is more preferably 0.008 mol/l and still more preferably 0.005 mol/l.

When forming organic silver salt nucleus particles by mixing a silver nitrate solution and a solution (or suspension) of an organic acid alkali salt using a pump, it is important to use a pump exhibiting no pulsation flow. Significant pulsation while pumping periodically and greatly alters supersaturation in the mixed portion of the silver nitrate solution and a solution (or suspension) of an organic acid alkali salt, thereby forming non-uniform nucleus particles and resulting in deteriorated monodispersibility of the formed particles. It is therefore preferred that the pulsation flow of a pump falls within±2% (more preferably±1.0%, and still more preferably±0.5%) of the average flow rate.

When the flow rate is measured once per sec. and its arithmetic average is defined as the average flow rate, the instantaneous variation in flow rate is preferably not more than 4%, which is defined as follows:

variation in flow rate (%)={(maximum flow rate minus minimum flow rate)/average flow rate}×100.

Thus, the fluctuation in flow rate preferably falls within±2%. Thereby, occurrence of a supersaturated zone in the solution forming organic silver salt particles is prevented, leading to formation of organic silver salt particles exhibiting superior dispersibility.

In this invention, mixing in the reaction apparatus is not specifically limited but it is preferred to be a substantially turbulent flow to prevent backflow or to achieve homogeneous mixing. A turbulent flow can be defined in terms of Reynolds number (also denoted simply as Re). The Reynolds number is a dimenensionless number and equals to the density of a fluid, times its velocity, times a characteristic length, divided by the fluid viscosity, as defined by $Re=DU\rho/\eta$, in which D is a characteristic length of a body in fluid and U, $\rho$, and $\eta$ are respectively a velocity, a density and viscosity of fluid. In general, it is called a laminar flow at $Re<2300$, a transition region at $2300<Re<3000$, and a turbulent flow at $Re>3000$. In this invention, turbulent flow refers to $Re>3000$, preferably $Re>5000$, and more preferably $Re>10000$, thereby resulting in homogeneous mixing of an aqueous solution containing silver ions and aqueous solution containing an organic acid alkali salt and forming monodisperse organic silver salt particles. The velocity U is a linear velocity, and the linear velocity preferably is not less than 1 m/sec, more preferably not less than 3.0 m/sec, and still more preferably not less than 5.0 m/sec.

In the process of continuous preparation of organic silver salt particles, a transient state exists from the start of preparation until reaching the predetermined particle formation condition, and particles formed in such a state are different in particle size from those formed in a steady-state. Introduction of these particles into a reaction vessel to use as nucleus particles to be grown or as a growth agent results in non-uniformity or deterioration in particle size distribution, caused by undissolved fine particles.

The embodiments of this invention concern a continuous preparation of organic silver salt particles exhibiting superior monodispersibility and enhanced production stability. Thus, in one preferred embodiment of the preparation method of organic silver salt particles in which at least two liquids of a solution containing silver ions and water or a mixture of water and an organic solvent as a medium, and a solution or suspension containing an organic acid alkali salt and water or a mixture of water and an organic solvent as a medium, are continuously supplied from plural supply tubes to a discharge tube to perform continuous formation of particles, liquid-supplying is continued using a switching device installed in the discharge side of the discharge tube until at least one of a mixing temperature, flow rate of supplied liquid, pAg at mixing, pH at mixing and set time reaches the prescribed range, and when or after at least one of the foregoing factors has reached the prescribed range, supply to the next process is started using the switching device, whereby organic silver salt particles exhibiting superior monodispersibility and stable performance can be achieved.

A switching device can be provided in a discharge tube from a reaction apparatus. The switching device can be structured by providing a switching valve and a separate pass. Alternatively, introduction/non-introduction to a reaction vessel may be switched using a movable pipe arrangement. To detect whether the steady-state is attained or not, it is preferred to monitor whether all of the flow rate, the pAg and pH at mixing, the temperature and the mixing time fall within the prescribed allowable range or not. However, particles produced in the transient state become an emulsion loss in the manufacture or increase loads of manufacturing facility-cost, so that at least one of the foregoing factors can be chosen in accordance with necessary characteristics of the particles. Before initiation of the manufacturing process, measurement is temporarily made to determine the time needed to reach the steady-state in advance, subsequent monitoring is not conducted, and switching is controlled using a timer. It is essential that nucleus particles or fine particles formed in the transient state are never sent to the next stage, that is, not used.

An apparatus for controlling the flow rate of added solution can employ commonly known control means. For example, the flow rate of an addition solution can be controlled employing control of the rotation number using a pump or feed-back control combining a flow-meter and a control valve. In another embodiment, the liquid flow rate after exiting the mixing device can be monitored. A device exhibiting little or no pulsation, such as a plunger pump or a syringe pump described JP-A No. 4181240 is preferable as a pump usable in this invention.

The exterior of the mixing device is covered with a jacket and the temperature at the time of mixing can be adjusted by controlling the temperature of internal liquid in the jacket. Alternatively, a jacket or a heat exchanger is installed in the pipeline of a solution containing silver ions or solution of organic acid alkali salt to control the temperature of the addition solution. The allowable temperature range is preferably within 5° C. (more preferably 3° C. and still more preferably 1° C.) of the prescribed temperature.

A silver ion-selective electrode known in the art is usable to monitor the pAg of the mixing device. When the pAg deviates from the prescribed value, it can be recovered by controlling the flow rate of the solution of silver salt or organic acid salt, or the solution of silver salt or organic acid salt other than that used for particle formation is prepared and added through a separate pass. In cases where it is difficult to install an electrode in relation to the structure of the mixing device, the electrode may be installed immediately following the mixing device. The allowable range of the pAg is preferably within 0.1 and more preferably within 0.05.

Figure 2:
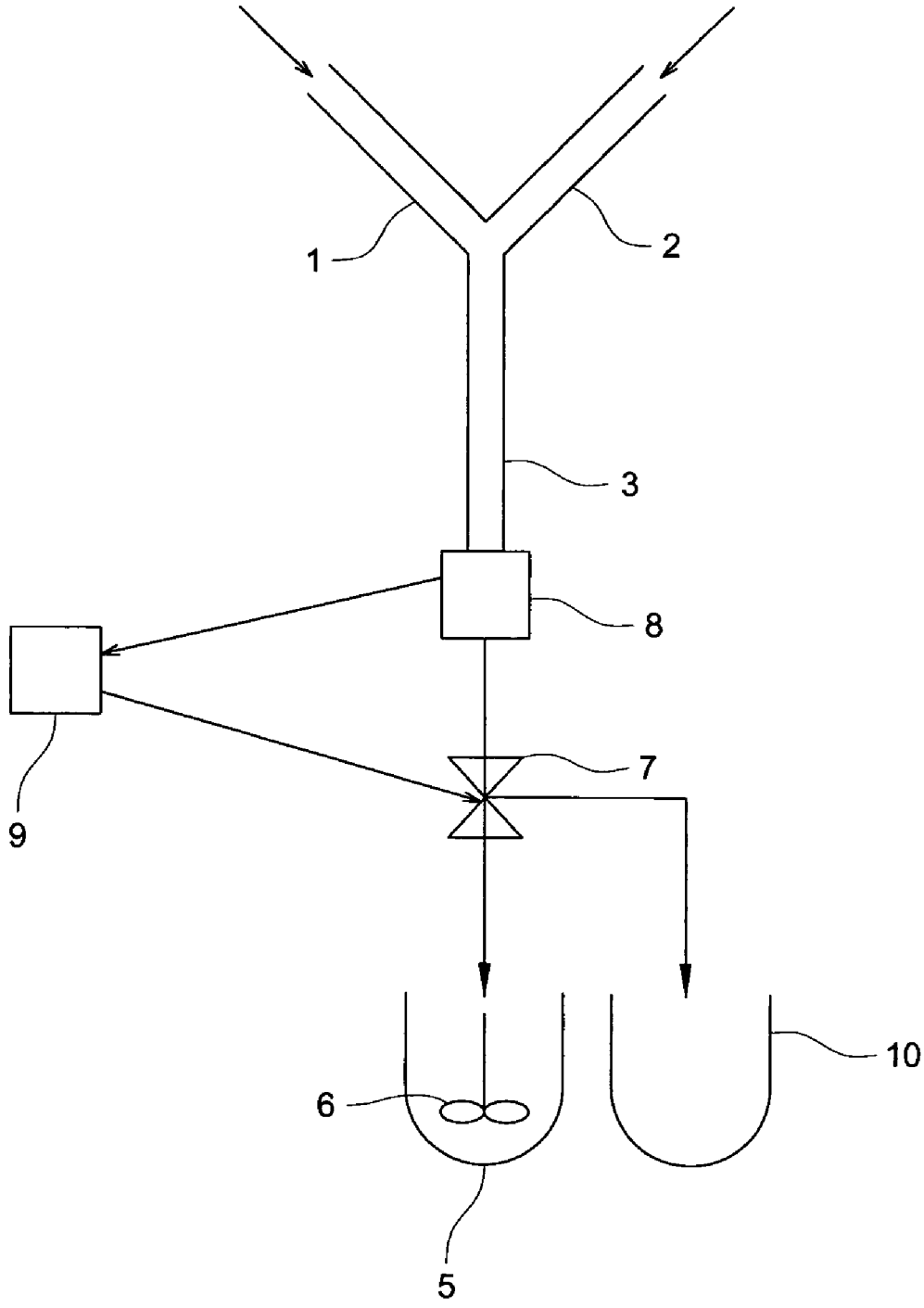
FIGS. 2 to 7 are illustrations of an apparatus for use in preparing organic silver salt particles.

FIG. 2 is an illustration of a preparing apparatus of organic silver salt particles, provided with a switching device. A solution or suspension of organic acid alkali salt is supplied through a supply tube (1) and a solution containing silver ions is supplied through supply tube (2), and both are mixed with each other at the mixing zone in which the supply tubes (1) and (2) are merge, forming organic silver salt particles. A sensor (8) detects silver potential, temperature, flow rate, pAg, pH or the like and its output is read in a control means (9). Based on information of these various conditions, the control means (9) controls a switching valve (7) as a switching device to discharge mixed solution to an effluent tank (10) until these conditions fall within the allowable range. The control means (9) allows the mixed solution to be discharged to a vessel (5) at the time when these condition values have fallen within the allowable range.

EXAMPLES

Example 1

| Preparation of Silver Halide Emulsion A | |
|---|---|
| Solution A1 | |
| Phenylcarbamoyl-modified gelatin | 88.3 g |
| Compound*[1] (10% aqueous methanol solution) | 10 ml |
| Potassium bromide | 0.32 g |
| Water to make | 5429 ml |
| Solution B1 | |
| 0.67 mol/L aqueous silver nitrate solution | 2635 ml |
| Solution C1 | |
| Potassium bromide | 51.55 g |
| Potassium iodide | 1.47 g |
| Water to make | 660 ml |

-continued

| Preparation of Silver Halide Emulsion A | |
|---|---|
| Solution D1 | |
| Potassium bromide | 154.9 g |
| Potassium iodide | 4.41 g |
| $K_3IrCl_6$ (equivalent to $4 \times 10^{-5}$ mol/Ag) | 50.0 ml |
| Water to make | 1982 ml |
| Solution E1 | |
| 0.4 mol/L aqueous potassium bromide solution in an amount to control silver potential | |
| Solution F1 | |
| Potassium hydroxide | 0.71 g |
| Water to make | 20 ml |
| Solution G1 | |
| 56% aqueous acetic acid solution | 18.0 ml |
| Solution H1 | |
| Sodium carbonate anhydride | 1.72 g |
| Water to make | 151 ml |

*[1]Compound A: $HO(CH_2CH_2O)_n(CH(CH_3)CH_2O)_{17}(CH_2CH_2O)_mH$ (m + N = 5 through 7)

Using a mixing stirrer shown in JP-B Nos. 58-58288 and 58-58289, ¼ portion of solution B1 and whole solution C1 were added to solution A1 over 4 minutes 45 seconds, employing a double-jet precipitation method while adjusting the temperature to 30° C. and the pAg to 8.09, whereby nucleus particles were formed. After one minute, whole solution F1 was added. During the addition, the pAg was appropriately adjusted employing Solution E1. After 6 minutes, ¾ portions of solution B1 and whole solution D1 were added over 14 minutes 15 seconds, employing a double-jet precipitation method while adjusting the temperature to 30° C. and the pAg to 8.09. After stirring for 5 minutes, the mixture was cooled to 40° C., and whole solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, solution H1 was added and the resultant mixture was heated to 60° C., and then stirred for an additional 120 minutes. Finally, the pH was adjusted to 5.8 and water was added so that the weight was adjusted to 1,161 g per mol of silver, whereby an emulsion was prepared.

The prepared emulsion was comprised of monodisperse cubic silver iodobromide grains having an average grain size of 0.040 μm, a grain size variation coefficient of 12 percent and a (100) crystal face ratio of 92 percent.

Preparation of Organic Silver Salt 1-1

Figure 3:
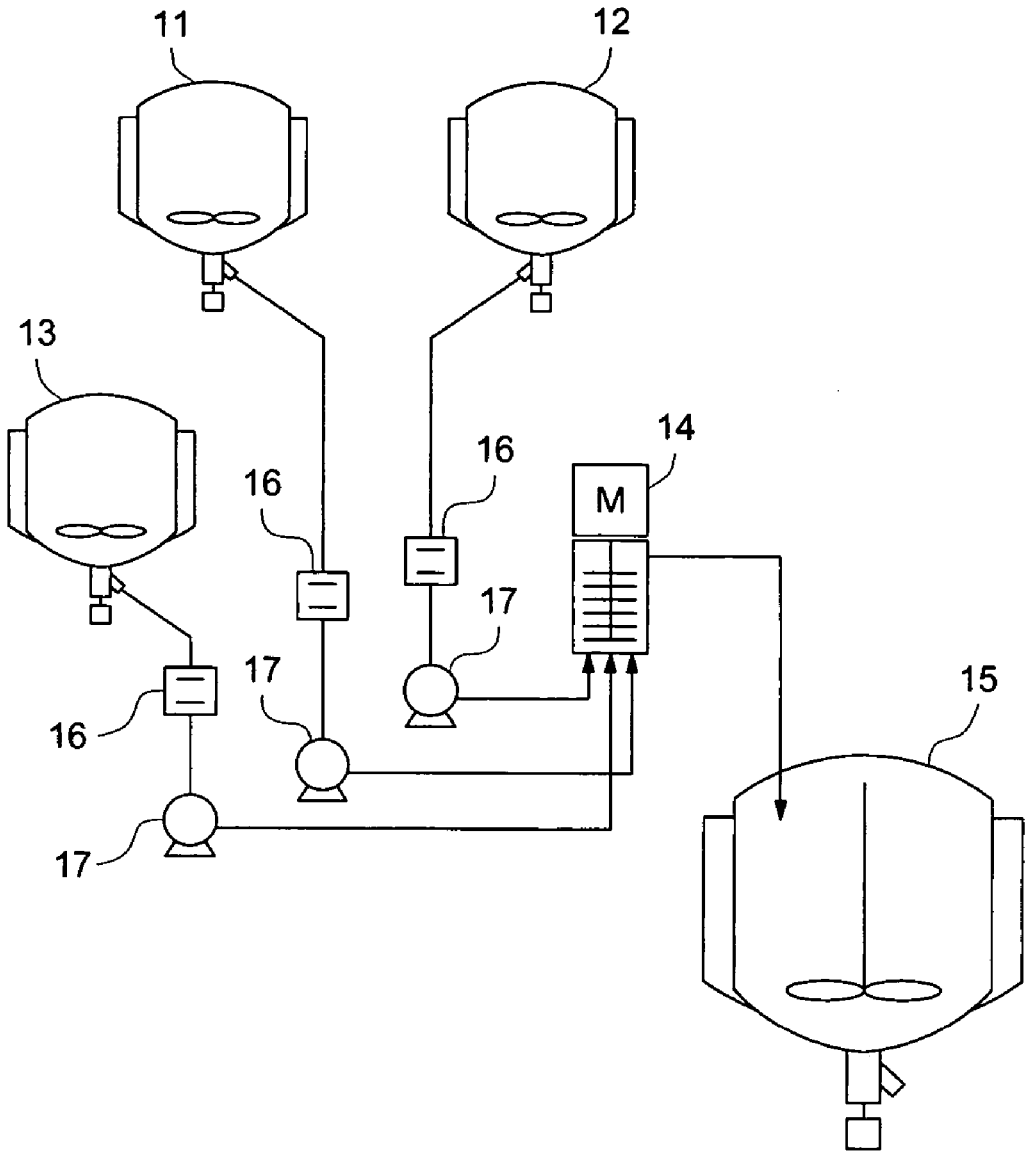

Particulate organic silver salt 1-1 was prepared using an apparatus, as shown in FIG. 3. Into a tank (11) containing 250 g of behenic acid and 4750 g of pure water was added 443 ml of 5N aqueous KOH solution over a period of 5 min. and allowed to react further for 60 min, while stirred at 85° C., whereby a potassium behenate solution was obtained. Finally, pure water was further added bringing the total amount to 6000 ml. Into a tank (12), 6000 ml of an aqueous solution containing 113 g of silver nitrate was placed and maintained at 10° C. Further to tank (13), 6000 ml of an aqueous solution in which 43 g of the foregoing light-sensitive silver halide emulsion A was dispersed, was put and maintained at 30° C. While stirring TK pipeline homomixer type M (14), produced by Tokushu Kika Kogyo co., Ltd.) at 10,000 rpm, the foregoing potassium behenate solution, aqueous silver nitrate solution and silver halide solution were each added thereto at a flow rate of 30 ml/min and stored in a tank (15). In FIG. 3, numerals 16 and 17 are a flowmeter and a pump, respectively. Then, solid contents were filtered off through suction filtration and washed with water until out-flow water reached a conductivity of 30 μS/cm. A dehydrated cake was obtained and dried at 40° C. for 72 hr. to obtain a dried powdery organic silver salt dispersion containing light-sensitive silver halide. Thus obtained organic silver salt particles were electron-microscopically observed and proved to be comprised of particles having an average projection area diameter (or equivalent circle diameter) of 0.63 μm, an average thickness of 0.21 μm and a coefficient of variation of equivalent sphere diameter of 27%.

Preparation of Organic Silver Salt 1-2

Figure 4:
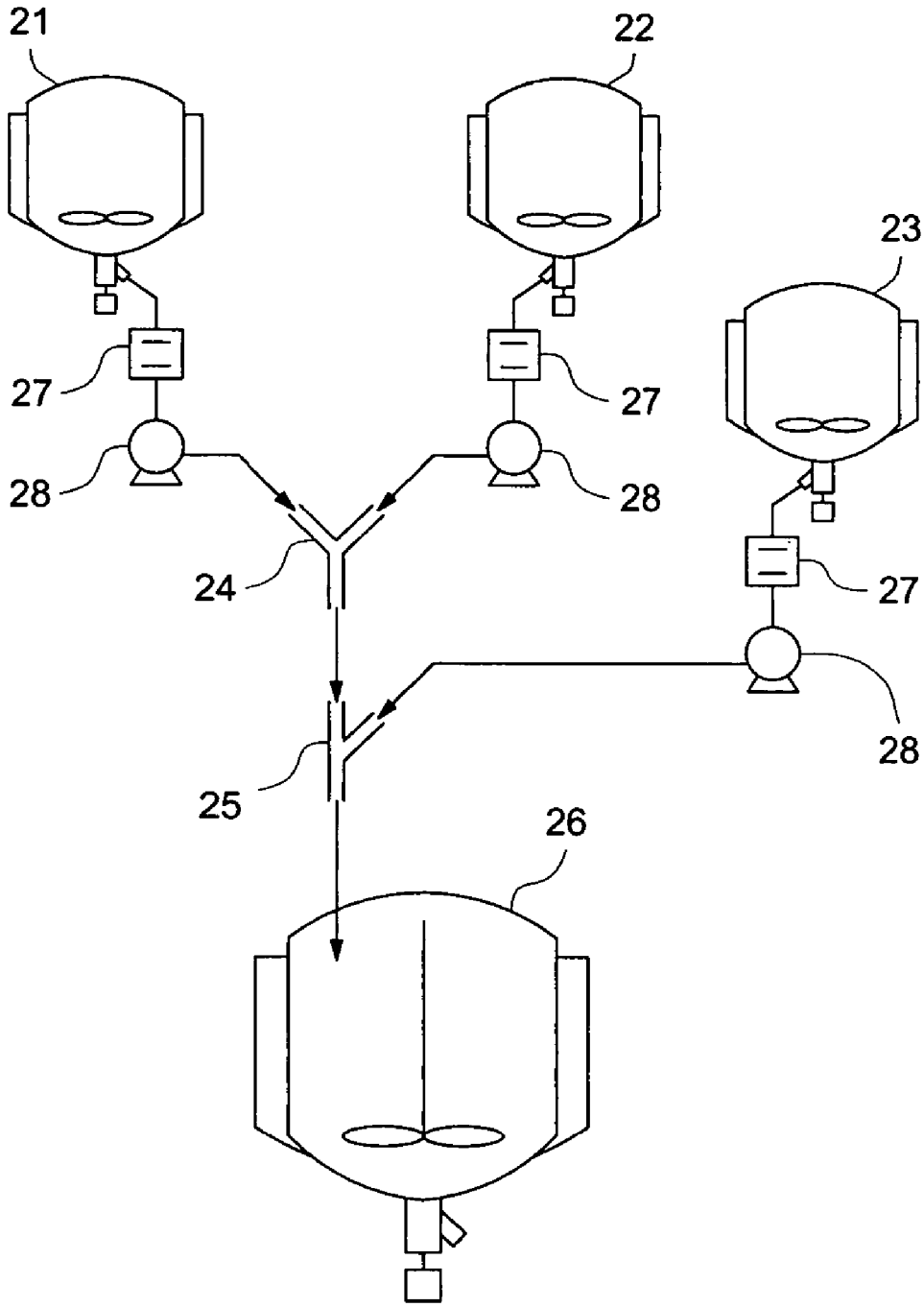

Particulate organic silver salt 1-2 was prepared using an apparatus, as shown in FIG. 4. Into a tank (21) containing 250 g of behenic acid and 4750 g of pure water was added 443 ml of 1.5N aqueous KOH solution over a period of 5 min. and allowed to react further for 60 min, while stirred at 85° C., whereby a potassium behenate solution was thus obtained. Finally, pure water was further added to make the total amount to 6000 ml. Into a tank (22), 6000 ml of an aqueous solution containing 113 g of silver nitrate was placed and maintained at 10° C. Further to tank (23), 6000 ml of an aqueous solution in which 43 g of the foregoing light-sensitive silver halide emulsion A was dispersed, was placed and maintained at 30° C. In FIG. 4, numerals 24 and 25 designate a mixing device shown in FIG. 1(*d*). The mixing devices (24) and (25), in which a supply tube and a discharge tube each had an inside diameter of 4 mm, were connected as shown in FIG. 4. The foregoing potassium behenate solution, aqueous silver nitrate solution and silver halide solution were each supplied at a flow rate of 1500 ml/min from tanks (21), (22) and (23), respectively, and stored in a tank (26). In FIG. 4, the numerals 27 and 28 are a flowmeter and a pump, respectively. Then, solid contents were filtered off through suction filtration and washed with water until penetrated water reached a conductivity of 30 μS/cm. A dehydrated cake was thus obtained and dried at 40° C. for 72 hr. to obtain a dried powdery organic silver salt dispersion containing light-sensitive silver halide. The obtained organic silver salt particles were electron-microscopically observed and proved to be comprised of particles having an average projection area diameter (or equivalent circle diameter) of 0.31 μm, an average thickness of 0.12 μm and a coefficient of variation of equivalent sphere diameter of 15%.

Preparation of Organic Silver Salt 1-3

Particulate organic silver salt 1-3 was prepared similarly to the foregoing organic silver salt 1-2, provided that mixing devices (24) and (25) were used and the potassium behenate solution, aqueous silver nitrate solution and silver halide solution were each supplied at a flow rate of 1000 ml/min. The thus obtained organic silver salt particles were electron-microscopically observed and proved to be comprised of particles having an average projection area diameter (or equivalent circle diameter) of 0.25 μm, an average thickness of 0.10 μm and a coefficient of variation of equivalent sphere diameter of 12%.

As can be seen from the foregoing, it was proved that organic silver salt particles prepared according to this invention exhibited relatively small sizes and enhanced monodispersibility.

Preparation of Light-Sensitive Dispersion A-1

In 728.5 g MEK was dissolved 7.3 g of a polymeric compound described below and further thereto, 250 g of the foregoing powdery organic silver salt 1-1 containing silver halide was gradually added to obtain preliminarily dispersed mixture, premix A-1, while stirring by a dissolver type homogenizer (DISPERMAT Type CA-40M, available from VMA-GETZMANN).

Copolymer of (a) and ethyl acetate

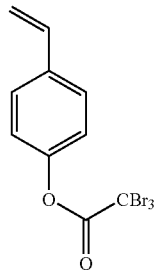

content of (a): 63% number-average molecular weight: 6000

Thereafter, using a pump, the foregoing premix A-1 was transferred to a media type dispersion machine (DISPERMAT Type SL-C12 EX, available from VMA-GETZMANN), which was packed 1 mm Zirconia beads (TORAYSELAM, available from Toray Co. Ltd.) by 80%, and dispersed at a circumferential speed of 8 m/s for 1.5 min. of a retention time with a mill to obtain light-sensitive emulsion A.

Preparation of Light-Sensitive Dispersions A-2 and A-3

Light-sensitive dispersion A-2 and A-3 were each prepared similarly to the foregoing light-sensitive dispersion A-1, provided that powdery organic silver salt 1-1 was replaced by powdery organic silver salt 1-2 and 1-3, respectively.

Preparation of Support

On one side of blue-tinted 175 μm thick polyethylene terephthalate film (PET) exhibiting a density of 0.170 which was previously subjected to a corona discharge treatment at 0.5 kV·A·min/$m^2$, sublayer (a) was coated using the following sublayer coating solution A so as to have a dry layer thickness of 0.2 μm. After the other side of the film was also subjected to a corona discharge treatment at 0.5 kV·A·min/$m^2$, sublayer (b) was coated thereon using sublayer coating solution B described below so as to have dry layer thickness of 0.1 μm. Thereafter, a heating treatment was conducted at 130° C. for 15 min in a heating treatment type oven having a film transport apparatus provided with plural rolls.

Sublayer Coating Solution A

Copolymer latex solution (30% solids) of 270 g, comprised of n-butyl acrylate/t-butyl acrylate/styrene/2-hydroxyethyl acrylate (30/20/25/25%) was mixed with 0.6 g of compound (UL-1) and 0.5 g of methyl cellulose. Further thereto a dispersion in which 1.3 g of silica particles (SILOID, available from FUJI SYLYSIA Co.) was previously dispersed in 100 g of water by a ultrasonic dispersing machine, Ultrasonic Generator (available from ALEX Corp.) at a frequency of 25 kHz and 600 W for 30 min., was added and finally water was added to make 100 ml to form sub-coating solution A. 152

Sub-Layer Coating Solution B

The foregoing colloidal tin oxide dispersion of 37.5 g was mixed with 3.7 g of copolymer latex solution (30% solids) comprised of n-butyl acrylate/t-butyl acrylate/styrene/2-hydroxyethyl acrylate (20/30/25/25%), 14.8 g of copolymer latex solution (30% solids) comprised of n-butyl acrylate/styrene/glycidyl methacrylate (40/20/40%), and 0.1 g of surfactant UL-1 (as a coating aid) and water-was further added to make 1000 ml to obtain sub-coating solution B.

Preparation of Colloidal Tin Oxide Dispersion

Stannic chloride hydrate of 65 g was dissolved in 2000 ml of water/ethanol solution. The prepared solution was boiled to obtain co-precipitates. The purified precipitate was taken out by decantation and washed a few times with distilled water. To the water used for washing, aqueous silver nitrate was added to confirm the presence of chloride ions. After confirming no chloride ion, distilled water was further added to the washed precipitate to make the total amount to 2000 ml. After adding 40 ml of 30% ammonia water was added and heated, heating was further continued and concentrated to 470 ml to obtain colloidal tin oxide dispersion.

UL-1

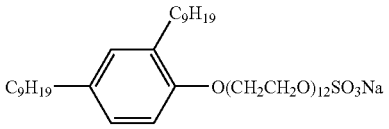

Thermally developable photothermographic material sample 101 was prepared according to the following procedure.

Back Layer-Side Coating

To 830 g of methyl ethyl ketone (also denoted as MEK), 4.2 g of polyester resin (Vitel PE2200B, available from Bostic Corp.) and 84.2 g of cellulose acetate-butyrate (CAB381-20, available from Eastman Chemical Co.) were added and dissolved. To the resulting solution, 0.30 g of infrared dye 1, 4.5 g of fluorinated surfactant-1 and 1.5 g of fluorinated surfactant (EF-TOP EF-105, product by JEMCO Co.) dissolved in 43.2 g of methanol were added with sufficiently stirring until being dissolved. To the resulting solution, 75 g of silica particles (SYLYSIA 450, available from FUJI SYLYSIA Co.) which was dispersed in methyl ethyl ketone at a concentration of 1% using a dissolver type homogenizer, was added to prepare a coating solution for the back-layer side.

Surfactabt-1: $C_9F_{17}O(CH_2CH_2O)_{22}C_9F_{17}$

The thus prepared back layer coating solution was coated on the sublayer (b) side of the support so as to form a dry thickness of 3.5 μm, using an extrusion coater and dried at a dry bulb temperature of 100° C. and a dew temperature of 100° C. for 5 min.

Infrared Dye 1

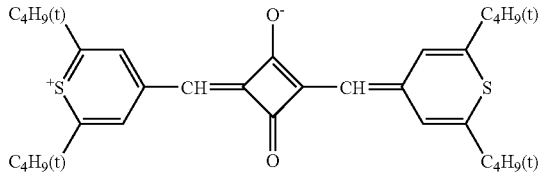

Light-Sensitive Layer-Side Coating

Preparation of Stabilizer Solution

In 4.97 g methanol were dissolved 1.0 g of Stabilizer-1 and 0.31 g of potassium acetate to obtain stabilizer solution.

Preparation of Infrared Sensitizing Dye Solution A

In 31.3 ml MEK were dissolved 19.2 mg of infrared sensitizing dye-1, 1.488 g of 2-chlorobenzoic acid, 2.779 g of Stabilizer-2 and 365 mg of 5-methyl-2-mercaptobenzimidazole in a dark room to obtain an infrared sensitizing dye solution A.

Preparation of Additive Solution (a)

In 110 g MEK were dissolved 27.98 g of 1,1-bis(2-hydroxy-3,5-dimethylphenyl)-3,5,5-trimethylhexane (denoted as reducing agent A), 1.54 g of 4-methylphthalic acid and 0.48 g of the infrared dye 1 to obtain additive solution (a).

Preparation of Additive Solution (b)

Antifoggants-2, of 3.56 g were dissolved in 40.9 g MEK to obtain additive solution (b).

Preparation of Light-Sensitive Layer Coating Solution A-1

Under inert gas atmosphere (97% nitrogen), 50 g of the light-sensitive emulsified dispersion A-1 and 15.11 g of MEK were maintained at 21° C. with stirring, and 390 μl of antifoggant-1 (10% methanol solution) was added and stirred for 1 hr. Further thereto, 494 μl of calcium bromide (10% methanol solution) was added and after stirring for 20 min. Subsequently, 1.32 g of infrared sensitizing dye solution A was added and stirred for 1 hr. Then, the mixture was cooled to 13° C. and stirred for 30 min. Further thereto, 13.31 g of the foregoing polymeric compound, as binder resin was added and stirred for 30 min, while maintaining the temperature at 13° C., and 1.084 g of tetrachlorophthalic acid (9.4% MEK solution) and stirred for 15 min. Then, 12.43 g of additive solution (a), 1.6 ml of 10% MEK solution of Desmodur N3300 (aliphatic isocyanate, product by Movey Co., 10% MEK solution)) and 4.27 g of additive solution (b) were successively added with stirring to obtain coating solution A-1 of the light-sensitive layer.

Stabilizer-1

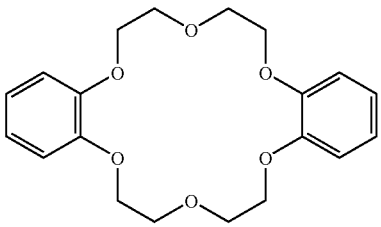

Stabilizer-2

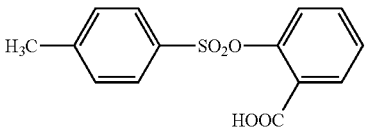

-continued

Infrared sensitizing dye-1

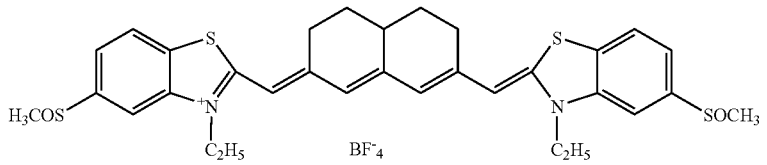

Antifoggant-2

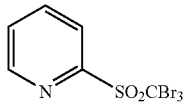

Antifoggant-1

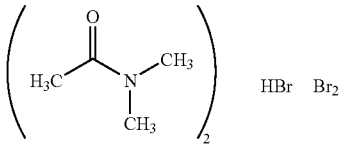

Preparation of Surface Protective Layer Coating Solution

To 865 g of MEK, 96 g of cellulose acetate-butyrate (CAB171-15, available from Eastman Chemical Co.), 4.5 g of polymethyl methacrylate (Paraloid A-21, available from Rohm & Haas Corp.), 1.0 g of benzotriazole, 1.5 g of a vinylsulfone compound (VSC) and 1.0 g of a fluorinated surfactant (EFTOP EF-105, available from JEMCO Co.) were added. Subsequently, 30 g of the foregoing matting agent dispersion was added thereto to prepare a surface protective layer coating solution.

Preparation of Matting Agent Dispersion

To 42.5 g of MEK, 7.5 g of cellulose acetate-butyrate (CAB171-15, available from Eastman Chemical Co.) was added with stirring. Further thereto, 5 g of Silica particles (SYLYSIA 320, available from FUJI SYLYSIA Co.) was added and stirred for 30 min. using a dissolver type homogenizer at 8,000 rpm to obtain a matting agent dispersion.

The foregoing light-sensitive layer coating solution A-1 and surface protective layer coating solution were simultaneously coated using a commonly known extrusion type coater. Coating was conducted so as to form a light-sensitive layer having a silver coverage of 1.5 g/m$^2$ and a 2.5 μm thick surface protective layer. Drying was carried out for 10 min with hot air of a dry bulb temperature of 75° C. and a dew point of 10° C. Photothermographic material sample 101 was thus obtained.

Photothermographic material samples 102 and 103 were prepared similarly to sample 101, provided that the light-sensitive dispersion A-1 used in the light-sensitive layer coating solution was replaced by light-sensitive dispersions A-2 and A-3, respectively.

Evaluation of Photothermographic Material

The thus prepared samples 101 to 103 were each evaluated in the following manner.

The samples were dived to two groups. One group of the samples was aged for 3 days under an atmosphere of 25° C. and 60% RH (which was denoted as ordinary-humidity sample), then, exposed using a sensitometer of a 810 nm semiconductor laser and thermally developed at 120° C. for 8 sec to form images. The other group of the samples was aged under an high humidity atmosphere of 35° C. and 78% RH (which was denoted high-humidity sample), and then exposed and thermally developed similarly to the foregoing. Laser exposure and thermal development of the foregoing ordinal humidity samples were conducted in the room conditioned at 25±1° C. and 54% RH.

The exposed and developed ordinary-humidity samples were each subjected to densitometry using a Macbeth densitometer to determine sensitivity (denoted S1) and fog density (denoted as F1), as instant performance. Sensitivity was represented by a relative value of the reciprocal of exposure necessary to give a density of a fog density plus 0.3, based on the sensitivity of sample 101 being 100.

The exposed and developed high-humidity samples were similarly subjected to densitometry to determine sensitivity (denoted S2) and fog density (denoted F2), and the difference in fog density between high-humidity and ordinary-humidity samples (ΔF=F2−F1) and the difference in sensitivity between high-humidity and ordinary-humidity samples (ΔS=S1−S2) were determined for the respective samples. Smaller differences in fog density and sensitivity (ΔF, ΔS) indicate superior raw stock stability. Results are shown in Table 1.

TABLE 1

| Sample | Photographic Performance: Instant Performance | | Photographic Performance: Raw Stock Stability | | Organic Silver Salt Particle: Average Size*1 | Organic Silver Salt Particle: Average Thickness | Organic Silver Salt Particle: C.V.*2 | |
|---|---|---|---|---|---|---|---|---|
| No. | F1 | S1 | ΔF | ΔS | (μm) | (μm) | (%) | Remark |
| 101 | 0.23 | 100 | 0.06 | 5 | 0.63 | 0.21 | 27 | Comp. |
| 102 | 0.19 | 106 | 0.03 | 2 | 0.31 | 0.12 | 15 | Inv. |
| 103 | 0.17 | 108 | 0.02 | 1 | 0.25 | 0.10 | 12 | Inv. |

*1average equivalent circle diameter

*2coefficient of variation of equivalent sphere diameter

As apparent from Table 1, organic silver salt particles prepared according to this invention exhibited smaller particle sizes and a smaller coefficient of variation of equivalent sphere diameter. It was also proved that photothermographic material samples using such organic silver salt particles resulted in superior instant performance and improved raw stock stability.

Example 2

A dry powdery organic silver salt dispersion of organic silver salt 2-1 was prepared similarly to the organic silver salt 1-2 of Example 1, except that the respective solutions were supplied using commercially available roller pumps. Thus obtained organic silver salt particles were electron-microscopically observed and proved to be comprised of particles having an average projection area diameter (or equivalent circle diameter) of 0.45 μm, an average thickness of 0.22 μm and a coefficient of variation of equivalent sphere diameter of 25%.

A dry powdery organic silver salt dispersion of organic silver salt 2-2 was prepared similarly to the foregoing organic silver salt 2-1, except that a plunger pump (product by Fuji Techno-Kogyo Co., Ltd.) was used in place of the roller pump. The variation I of the plunger pump with respect to a preset value was±1.2% of the average flow rate. Thus obtained organic silver salt particles were electron-microscopically observed and proved to be comprised of particles having an average projection area diameter (or equivalent circle diameter) of 0.30 μm, an average thickness of 0.14 μm and a coefficient of variation of equivalent sphere diameter of 15%.

Using organic silver salt 2-2, photothermographic material sample 202 was prepared and evaluated similarly to Example 1. Results are shown in Table 2.

TABLE 2

| | Photographic Performance | | | | Organic Silver Salt | | | |
|---|---|---|---|---|---|---|---|---|
| | Instant | | Raw | | Particle | | | |
| Sample | Performance | | Stock Stability | | Average Size*1 | Average Thickness | C.V.*2 | |
| No. | F1 | S1 | ΔF | ΔS | (μm) | (μm) | (%) | Remark |
| 201 | 0.18 | 104 | 0.01 | 1 | 0.30 | 0.14 | 15 | Inv. |

As can be seen from Table 2, organic silver salt particles exhibited a smaller coefficient of variation of particle diameter and superior photographic performance.

Example 3

Figure 5:
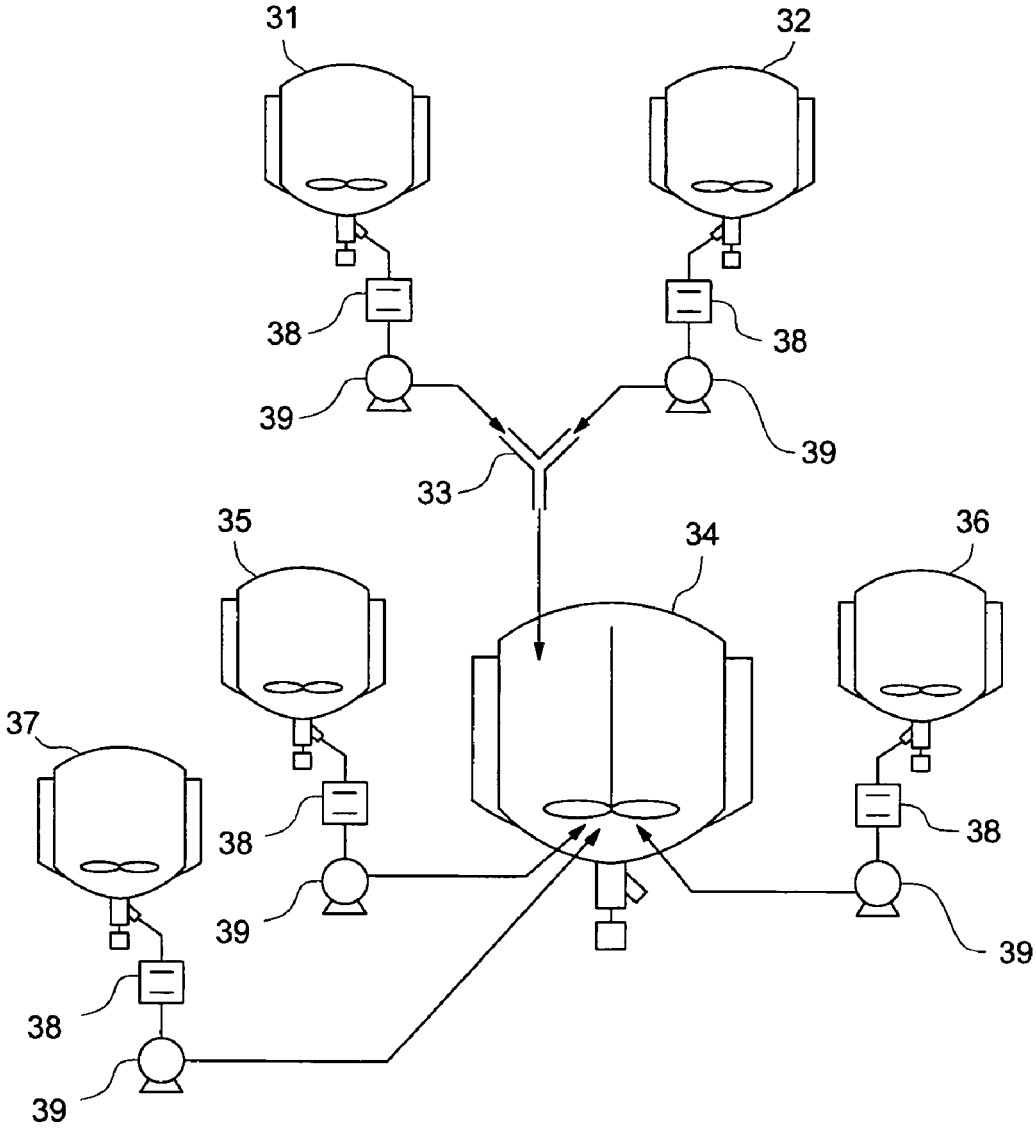

Using the apparatus shown in FIG. 5, particulate organic silver salt 3-1 was prepared in the following manner. Into a tank (31) containing 83.5 g of behenic acid and 1583.5 g of pure water, while stirring at 85° C., 147.7 ml of 1.5N aqueous KOH solution was added over 5 min. and allowed to react further for 60 min. to obtain a potassium behenate solution. Finally, water was added to make the total amount to 2000 ml. To a tank (32), 2000 ml of aqueous solution containing 37.6 g of silver nitrate was fed and maintained at 10° C. In FIG. 5, the numeral 33 designates the mixing device shown in FIG. 1(*a*). To the mixing device (33), in which a supply tube and a discharge tube, each had an inside diameter of 4 mm, the foregoing potassium behenate solution and aqueous silver nitrate solution were supplied at a flow rate of 1500 ml/min and allowed to undergo nucleation. During the nucleation, the silver potential was continuously measured and after the variation thereof fell within 2 mV, 1500 ml of nucleus particles (or nucleus particles) was taken out and used in the subsequent stage. The variation of silver potential was 1.8 mV over the entire nucleation time. In FIG. 5, numerals 38 and 39 designate a flowmeter and a pump, respectively.

To a tank (34) containing 1000 ml of pure water kept at 30° C., the foregoing nucleus particles were continuously introduced. Into a tank (35) containing 218.7 g of behenic acid and 4155.3 g of pure water with stirring at 85° C., 387.3 ml of 1.5N aqueous KOH solution was added in 5 min. and reacted further for 60 min. to obtain a potassium behenate solution. Finally, water was added to make the total amount to 5250 ml. To a tank (36), 1050 ml of aqueous solution containing 98.7 g of silver nitrate was added and maintained at 10° C. Further, 525 ml of an aqueous solution containing 43 g of light-sensitive silver halide emulsion A was prepared in a tank (37) and maintained at 30° C. The foregoing potassium behenate solution, aqueous silver nitrate solution and silver halide solution were added by triple jet addition at flow rates of 150 ml/min. 30 ml/min and 15 ml/min, respectively to perform particle growth.

Then, the solid contents were filtered off through suction filtration and washed with water until the penetrated water reached a conductivity of 30 μS/cm. A dehydrated cake was obtained and dried at 40° C. for 72 hrs. to obtain a dried powdery organic silver salt dispersion containing light-sensitive silver halide. The thus obtained organic silver salt particles were electron-microscopically observed and proved to be comprised of particles having an average projection area diameter (or equivalent circle diameter) of 1.01 μm, an average thickness of 0.38 μm and a coefficient of variation of equivalent sphere diameter of 18%.

Using the obtained organic silver salt, photothermographic material sample 3-1 was prepared and evaluated similarly to Example 1. Results are shown in Table 3.

TABLE 3

| | Photographic Performance | | | | Organic Silver Salt | | | |
|---|---|---|---|---|---|---|---|---|
| | Instant | | Raw | | Particle | | | |
| Sample | Performance | | Stock Stability | | Average Size*1 | Average Thickness | C.V.*2 | |
| No. | F1 | S1 | ΔF | ΔS | (μm) | (μm) | (%) | Remark |
| 301 | 0.20 | 105 | 0.01 | 1 | 1.01 | 0.38 | 18 | Inv. |

As can be seen from Table 3, organic silver salt particles prepared according to this invention exhibited smaller coefficient of variation of particle diameter and superior photographic performance.

Example 4

Using an apparatus shown in FIG. 5, particulate organic silver salt 4-1 was prepared in the following manner. Into a tank (31) containing 5.7 g of behenic acid and 650 g of pure water with stirring at 85° C., 10.0 ml of 1.5N aqueous KOH solution was added in 5 min. and reacted further for 60 min. to obtain a potassium behenate solution. Finally, water was added to make the total amount to 750 ml. To a tank (32), 750 ml of aqueous solution containing 2.6 g of silver nitrate was added and maintained at 10° C. To the mixing device (33) in which a supply tube and a discharge tube, each had an inside diameter of 4 mm, the foregoing potassium behenate solution and aqueous silver nitrate solution were supplied at a flow rate of 1500 ml/min to perform nucleation. The silver content of the organic silver salt particles was 0.01 mol/l/.

To a tank (34) containing 1000 ml of pure water kept at 30° C., the foregoing nucleus particles were continuously introduced. Into a tank (35) containing 244.3 g of behenic acid and 4750 g of pure water with stirring at 85° C., 432.7 ml of 5N aqueous KOH solution was added in 5 min. and reacted further for 60 min. to obtain a potassium behenate solution. Finally, water was added to make the total amount to 6000 ml. To a tank (36), 1050 ml of aqueous solution containing 110.3 g of silver nitrate was added and maintained at 10° C. Further, 600 ml of an aqueous solution containing 43 g of light-sensitive silver halide emulsion A was prepared in a tank (37) and maintained at 30° C. The foregoing potassium behenate solution, aqueous silver nitrate solution and silver halide solution were added by triple jet addition at flow rates of 150 ml/min. 30 ml/min and 15 ml/min, respectively to undergo particle growth.

Then, the solid contents were filtered off through suction filtration and washed with water until penetrating water reached a conductivity of 30 μS/cm. A dehydrated cake was obtained and dried at 40° C. for 72 hr. to obtain a dried powdery organic silver salt dispersion containing light-sensitive silver halide. Thus obtained organic silver salt particles were electron-microscopically observed and proved to be comprised of particles having an average projection area diameter (or equivalent circle diameter) of 1.16 μm, an average thickness of 0.51 μm and a coefficient of variation of equivalent sphere diameter of 15%.

Particulate organic silver salts 4-2 and 4-3 were prepared similarly to the foregoing organic silver salt 4-1, provided that conditions in the nucleation stage and the growth stage were changed as shown in Table 4.

TABLE 4

| | Nucleation | | | | Growth | | |
|---|---|---|---|---|---|---|---|
| Organic Silver Salt | Behenic Acid (g) | KOH (ml) | Silver nitrate (g) | Silver Content (mol/l) | Behenic Acid (g) | KOH (ml) | Silver nitrate (g) |
| 4-1 | 5.7 | 10.0 | 2.6 | 0.01 | 244.3 | 432.7 | 110.3 |
| 4-2 | 4.5 | 8.0 | 2.0 | 0.008 | 245.5 | 434.8 | 110.8 |
| 4-3 | 2.8 | 5.0 | 1.3 | 0.005 | 247.2 | 437.8 | 111.6 |

Photothermographic material samples 401 to 403 were prepared and evaluated similarly to Example 1, except that particulate organic silver salts 4-1 to 4-3 were each used. Results are shown in Table 5.

TABLE 5

| | Photographic Performance | | | | Organic Silver Salt | | | |
|---|---|---|---|---|---|---|---|---|
| | Instant | | Raw | | Particle | | | |
| Sample | Performance | | Stock Stability | | Average Size*1 | Average Thickness | C.V.*2 | |
| No. | F1 | S1 | ΔF | ΔS | (μm) | (μm) | (%) | Remark |
| 401 | 0.18 | 105 | 0.02 | 2 | 1.16 | 0.51 | 15 | Inv. |
| 402 | 0.18 | 105 | 0.01 | 2 | 1.18 | 0.55 | 14 | Inv. |
| 403 | 0.17 | 106 | 0.01 | 1 | 1.20 | 0.56 | 12 | Inv. |

As can be seen from Table 5, organic silver salt particles prepared according to this invention exhibited a lower coefficient of variation of particle diameter and superior photographic performance.

Example 5

Figure 6:
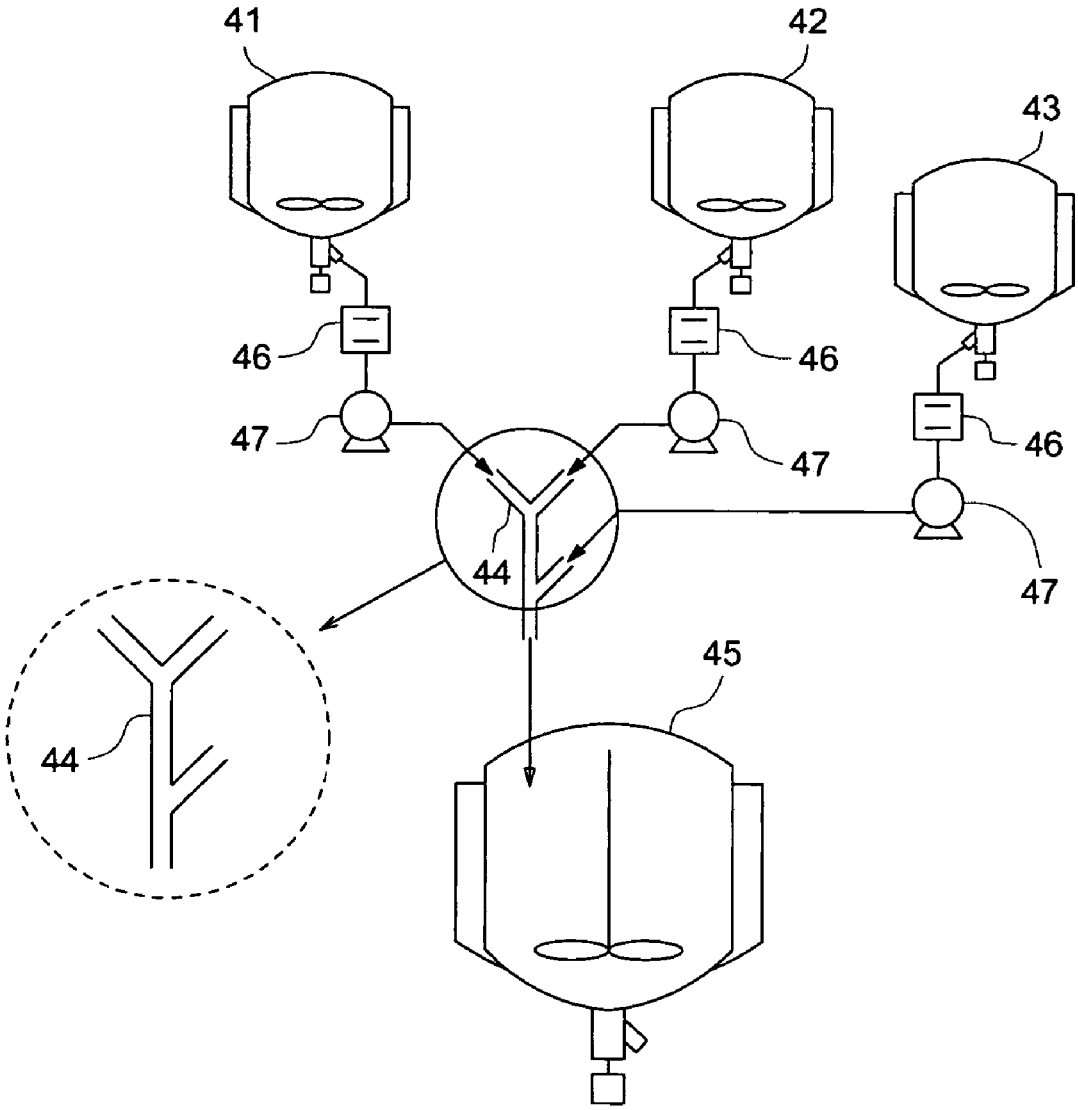

Particulate organic silver salt 5-1 was prepared using the apparatus shown in FIG. 6. Into a tank (41) containing 250 g of behenic acid and 4750 g of pure water was added 443 ml of 1.5N aqueous KOH solution over a period of 5 min. and allowed to react further for 60 min, while stirring at 85° C., whereby a potassium behenate solution was obtained. Finally, pure water was further added to make the total amount to 6000 ml. Into a tank (42), 6000 ml of an aqueous solution containing 113 g of silver nitrate was put and maintained at 10° C. Into tank (43), 600 ml of an aqueous solution, in which 43 g of the foregoing light-sensitive silver halide emulsion A had been dispersed, was put and maintained at 30° C. In FIG. 6, the numeral 44 designate the mixing device shown in FIG. 1(*d*). The mixing device (44) in which the supply tubes for potassium behenate and an aqueous silver nitrate solution each had an inside diameter of 5 mm, the supply tube for a silver halide solution had an inside diameter of 1 mm and the discharge tube each had an inside diameter of 4 mm, were connected as shown in FIG. 6. The foregoing potassium behenate solution and aqueous silver nitrate solution were each supplied at a flow rate of 1500 ml/min, while silver halide solution was supplied at a flow rate of 150 ml/min and stocked in tank (45). In FIG. 6, numerals 46 and 47 are a flowmeter and a pump, respectively. Solid contents were then filtered off through suction filtration and washed with water until penetrating water reached a conductivity of 30 μS/cm. A dehydrated cake was obtained and dried at 40° C. for 72 hr. to obtain a dried powdery organic silver salt dispersion containing light-sensitive silver halide. The obtained organic silver salt particles were electron-microscopically observed and proved to be comprised of particles having an average projection area diameter (or equivalent circle diameter) of 0.33 μm, an average thickness of 0.12 μm and a coefficient of variation of equivalent sphere diameter of 14%.

Particulate organic silver salts 5-2 and 5-3 were prepared similarly to the foregoing organic silver salt 5-1, provided that mixing conditions were changed, as shown in Table 6.

TABLE 6

| Organic Silver Salt | Inside Diameter (mm) of Supply Tubes of Potassium Behenate and Silver nitrate (mm) | Inside Diameter of Discharge Tube (mm) |
|---|---|---|
| 5-1 | 6 | 4 |
| 5-2 | 4 | 4 |
| 5-3 | 2 | 2 |

Photothermographic material samples 501 to 503 were prepared and evaluated with respect to photographic performance similarly to Example 1, provided that the foregoing organic silver salts 5-1 to 5-3 were used. Results are shown in Table 7.

TABLE 7

| Sample No. | Photographic Performance: Instant Performance F1 | S1 | Raw Stock Stability ΔF | ΔS | Mixing Condition: Supply Tube Diameter (mm) | Discharge Tube Diameter (mm) | Re No. in Mixing Portion | Linear Velocity (m/sec) | Organic Silver Salt Particle: Average Size*1 (μm) | Average Thickness (μm) | C.V.*2 (%) | Remark |
|---|---|---|---|---|---|---|---|---|---|---|---|---|
| 501 | 0.20 | 104 | 0.03 | 2 | 6 | 4 | 3183 | 0.88 | 0.33 | 0.12 | 14 | Inv. |
| 502 | 0.18 | 105 | 0.02 | 2 | 4 | 4 | 3183 | 1.99 | 0.25 | 0.10 | 12 | Inv. |
| 503 | 0.16 | 107 | 0.01 | 1 | 2 | 2 | 6366 | 7.96 | 0.22 | 0.08 | 11 | Inv. |

*1average equivalent circle diameter

*2coefficient of variation of equivalent sphere diameter

As can be seen from Table 7, organic silver salt particles prepared according to this invention exhibited a smaller coefficient of variation of particle diameter and superior photographic performance.

Example 6

Figure 7:
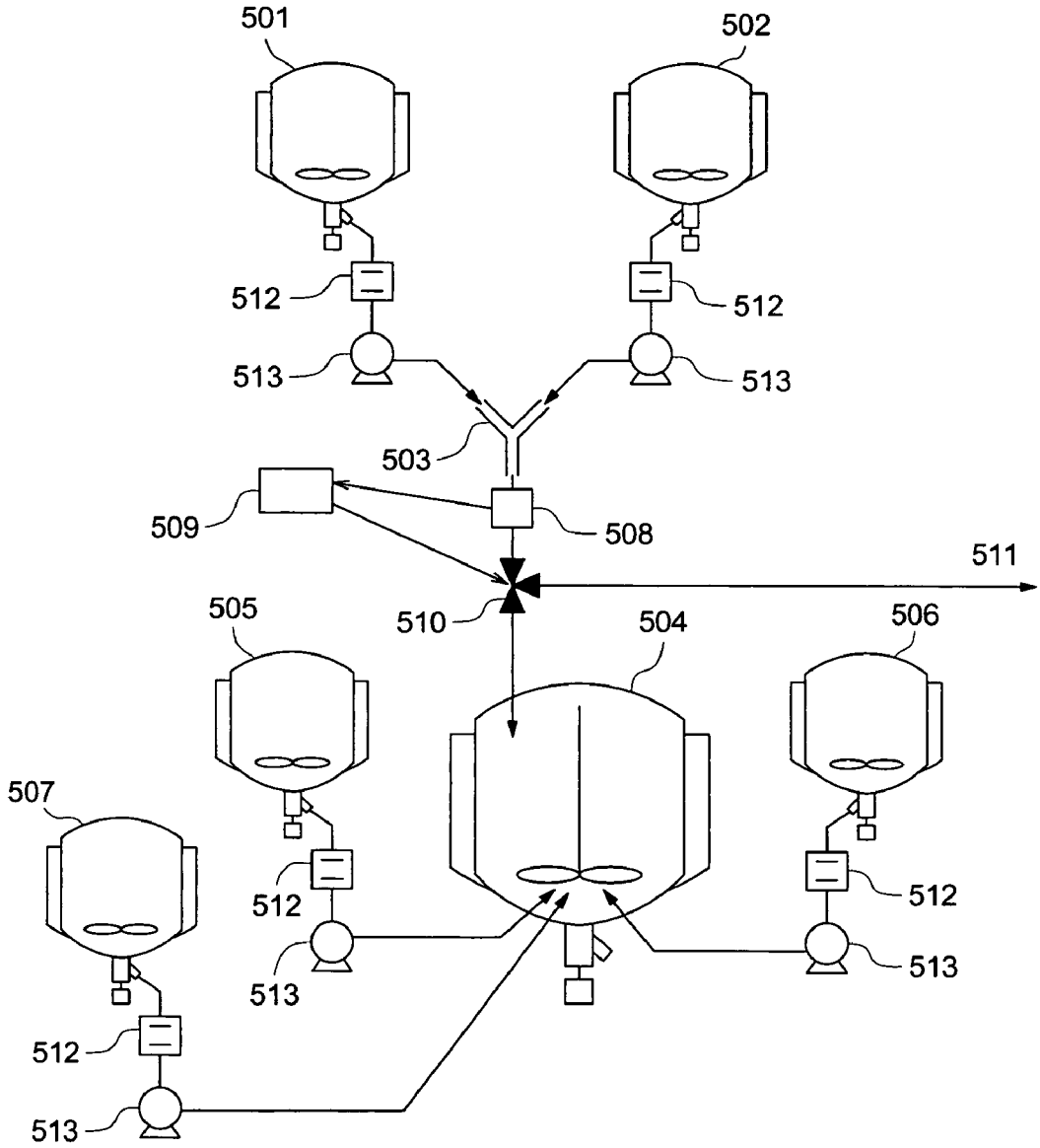

Using the apparatus shown in FIG. 7, particulate organic silver salt 6-1 was prepared in the following manner. Into a tank (501) containing 83.5 g of behenic acid and 1583.5 g of pure water with stirring at 85° C., 147.7 ml of 1.5N aqueous KOH solution was added in 5 min. and reacted further for 60 min. to obtain a potassium behenate solution. Finally, water was added to make the total amount to 2000 ml. To a tank (502), 2000 ml of aqueous solution containing 37.6 g of silver nitrate was added and maintained at 10° C. In FIG. 7, the numeral 33 designates the mixing device, as shown in FIG. 1(*a*). To the mixing device (33) in which a supply tube and a discharge tube each had an inside diameter of 4 mm, the foregoing potassium behenate solution and aqueous silver nitrate solution were supplied at a flow rate of 750 ml/min and allowed to undergo nucleation. During the nucleation, the silver potential was continuously measured by a sensor (508). The acceptable pH range was set within±0.05 and a switching valve was operated to allow solution to discharge through pass (511) outside of a tank (504) until the pH fell within the foregoing range. A steady state was attained 15 sec. from the start of addition and the switching valve (510) was concurrently operated to introduce formed nucleus particles into a tank (504). Further, when the total amount of formed nucleus particles reached 1500 ml, the switching valve (510) was operated to allow solution to discharge through the pass (511) outside of the tank (504). In FIG. 7, the numeral 508 designates a sensor for detecting various conditions such as temperature, silver potential, pH and pAg; the numeral 509 designates a control means constituted of a computer; the numerals 512 and 513 designate a flowmeter and a pump, respectively.

Solid contents were then filtered off through suction filtration and washed with water until the penetrated water reached a conductivity of 30 μS/cm. A dehydrated cake was obtained and dried at 40° C. for 72 hrs. to obtain a dried powdery organic silver salt dispersion containing light-sensitive silver halide. The obtained organic silver salt particles (6-1) were electron-microscopically observed and proved to be comprised of particles having an average projection area diameter (or equivalent circle diameter) of 0.99 μm, an average thickness of 0.45 μm and a coefficient of variation of equivalent sphere diameter of 19%.

Particulate organic silver salt 6-2 was prepared in a similar manner. Using the addition solutions used in the nucleation of the foregoing particulate organic silver salt (6-1), nucleus particles were formed using an apparatus shown in FIG. 7. Organic silver salt particles (6-2) were prepared similarly to the foregoing organic silver salt particles (6-1), provided that monitoring of the flow rate and the pH was not done and using a timer, the switching valve was operated 15 sec. after the start of addition so that the pass (511) was changed to pass into the tank (504). The obtained organic silver salt particles (6-2) were electron-microscopically observed and proved to be comprised of particles having an average projection area diameter (or equivalent circle diameter) of 0.97 μm, an average thickness of 0.44 μm and a coefficient of variation of equivalent sphere diameter of 18%.

Particulate organic silver salt 6-3 was prepared in a similar manner. Using addition solutions used in the nucleation of the foregoing particulate organic silver salt (6-1), nucleus particles were formed using the apparatus shown in FIG. 7. The acceptable ranges of flow rate, pH and temperature were each set within±1%, ±0.05 and ±0.5° C., respectively, and a switching valve was operated to allow solution to discharge through pass (511) to the outside of a tank (504) until the pH fell within the foregoing range. The steady state was attained 25 sec. from the start of addition and concurrently, the switching valve (510) was operated so that the pass (511) was changed to pass to the tank (504). Organic silver salt particles (603) were prepared similarly to organic silver salt particles (601), except for the foregoing. Thus obtained organic silver salt particles (6-3) were electron-microscopically observed and proved to be comprised of particles having an average projection area diameter (or equivalent circle diameter) of 0.96 μm, an average thickness of 0.42 μm and a coefficient of variation of equivalent sphere diameter of 17%.

Photothermographic material samples 601 to 603 were prepared and evaluated with respect to photographic performance similarly to Example 1, provided that the foregoing organic silver salts 6-1 to 6-3 were used. Results are shown in Table 8.

TABLE 8

| Sample | Photographic Performance: Instant Performance | | Photographic Performance: Raw Stock Stability | | Organic Silver Salt: Particle | | | |
|---|---|---|---|---|---|---|---|---|
| No. | F1 | S1 | ΔF | ΔS | Average Size*1 (μm) | Average Thickness (μm) | C.V.*2 (%) | Remark |
| 601 | 0.19 | 104 | 0.02 | 2 | 0.99 | 0.45 | 19 | Inv. |
| 602 | 0.18 | 105 | 0.02 | 2 | 0.97 | 0.44 | 18 | Inv. |
| 603 | 0.17 | 105 | 0.01 | 1 | 0.96 | 0.42 | 17 | Inv. |

As can be seen from Table 8, organic silver salt particles prepared according to this invention exhibited smaller coefficient of variation of particle diameter and superior photographic performance.

What is claimed is:

1. A method of preparing organic silver salt particles comprising:

(a) supplying an aqueous solution containing silver ions and an aqueous solution containing an organic acid alkali salt, (b) mixing the aqueous solution containing silver ions with the aqueous solution containing an organic acid alkali salt to form organic silver salt particles, and (c) discharging a solution containing the organic silver salt particles, wherein the aqueous solution containing silver ions and the aqueous solution containing an organic acid alkali salt are each supplied through supply tubes (1) and (2), respectively and the solution containing the organic silver salt particles is discharged through a discharge tube, wherein a center axis of the discharge tube coincides at a single point with center axes of the supply tubes (1) and (2).

2. The method of claim 1, wherein the supply tubes (1) and (2) and the discharge tube each have an inside diameter of 1 mm to 100 mm.

3. The method of claim 1, wherein the aqueous solution containing silver ions and the aqueous solution containing an organic acid alkali salt are each supplied at a flow rate with a fluctuation falling within ±2% of a predetermined flow rate.

4. The method of claim 1, wherein the method further comprises (d) supplying the organic acid alkali salt and the silver ions to the solution containing the organic silver salt particles to allow the organic silver salt particles to grow.

5. The method of claim 4, wherein in (b), the mixing is performed with monitoring a silver potential and the organic silver salt particles formed after a variation of the silver potential falls within 2 mV are grown.

6. The method of claim 1, wherein the organic silver salt particles are formed in an amount of not more than 0.01 mol/l with respect to silver content.

7. The method of claim 1, wherein in (b), the mixing is performed in a mixing zone with a turbulent flow exhibiting a Reynolds number of not less than 3,000.

8. The method of claim 1, wherein the aqueous solution containing silver ions and the aqueous solution containing an organic acid alkali salt are each supplied at a linear velocity of not less than 1.0 m/sec.

9. The method of claim 1, wherein the method further comprises (e) supplying a solution containing silver halide grains to the solution containing the organic silver salt particles.

10. A method of preparing organic silver salt particles comprising:

(a) supplying an aqueous solution containing silver ions and an aqueous solution containing an organic acid alkali salt, (b) mixing the aqueous solution containing silver ions with the aqueous solution containing an organic acid alkali salt to form organic silver salt particles, and (c) discharging a solution containing the organic silver salt particles, wherein the aqueous solution containing silver ions is mixed with the aqueous solution containing an organic acid alkali salt using a mixing device in which a discharge tube for discharging the solution containing the organic silver salt particles is connected to supply tubes (1) and (2) for supplying the aqueous solution containing silver ions and the aqueous solution containing an organic acid alkali salt so that a center axis of the discharge tube coincides at a single point with center axes of the supply tubes (1) and (2).

11. The method of claim 10, wherein the supply tubes (1) and (2) and the discharge tube each have an inside diameter of 1 mm to 100 mm.

12. The method of claim 10, wherein the aqueous solution containing silver ions and the aqueous solution containing an organic acid alkali salt are each supplied at a flow rate with a fluctuation falling within ±2% of a predetermined flow rate.

13. The method of claim 10, wherein the method further comprises (d) supplying the organic acid alkali salt and the silver ions to the solution containing the organic silver salt particles to allow the organic silver salt particles to grow.

14. The method of claim 13, wherein in (b) the mixing is performed with monitoring a silver potential and the organic silver salt particles formed after a variation of the silver potential falls within 2 mV are grown.

15. The method of claim 10, wherein the organic silver salt particles are formed in an amount of not more than 0.01 mol/l with respect to silver content.

16. The method of claim 10, wherein in (b), the mixing is performed in a mixing zone with a turbulent flow exhibiting a Reynolds number of not less than 3,000.

17. The method of claim 10, wherein the aqueous solution containing silver ions and the aqueous solution containing an organic acid alkali salt are each supplied at a linear velocity of not less than 1.0 m/sec.

18. The method of claim 10, wherein a supply tube (3) is further connected to the discharge tube.

19. The method of claim 10, wherein the method further comprises (e) supplying a solution containing silver halide grains to the solution containing the organic silver salt particles.

* * * * *